US007264332B2

(12) United States Patent
Oishi

(10) Patent No.: US 7,264,332 B2
(45) Date of Patent: Sep. 4, 2007

(54) INKJET HEAD AND NOZZLE PLATE OF INKJET HEAD

(75) Inventor: Tatsuo Oishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 161 days.

(21) Appl. No.: 11/006,768

(22) Filed: Dec. 8, 2004

(65) Prior Publication Data

US 2005/0122376 A1 Jun. 9, 2005

(30) Foreign Application Priority Data

Dec. 9, 2003 (JP) ..... 2003-409794

(51) Int. Cl.
*B41J 2/15* (2006.01)
*B41J 2/145* (2006.01)

(52) U.S. Cl. ..... 347/40

(58) Field of Classification Search ..... 347/40
See application file for complete search history.

(56) References Cited

U.S. PATENT DOCUMENTS 6,310,637 B1 * 10/2001 Shimada et al. ..... 347/19
6,886,904 B2 * 5/2005 Otsuki ..... 347/19
2004/0150693 A1 8/2004 Kojima et al.

FOREIGN PATENT DOCUMENTS

| | | |
|---|---|---|
| EP | 0 773 108 A2 | 5/1997 |
| EP | 1 316 427 A1 | 6/2003 |
| JP | A 2002-103604 | 4/2002 |
| JP | A 2003-237078 | 8/2003 |

* cited by examiner

*Primary Examiner*—Thinh Nguyen
(74) *Attorney, Agent, or Firm*—Oliff & Berridge, PLC

(57) ABSTRACT

An inkjet head includes plural nozzles that eject ink. The nozzles are arranged so that (a) the nozzles are arranged in a first direction on an ink ejection surface to form a plurality of rows parallel to one another; and (b) when the nozzles are projected from a second direction, which is parallel to the ink ejection surface and perpendicular to the first direction, onto a virtual straight line extending in the first direction, projective dots of the nozzles are arranged at equally spaced intervals on the virtual straight line. A spatial frequency, which is determined based on an appearance interval of a most-distant adjacent projective dot pair in the first direction, is lower than a spatial frequency corresponding to a peak value of a visual transfer function.

19 Claims, 12 Drawing Sheets

INKJET HEAD AND NOZZLE PLATE OF INKJET HEAD

BACKGROUND OF THE INVENTION

1. Field of the Invention

The present invention relates to an inkjet head having pressure chambers arrayed in a matrix.

2. Description of the Related Art

JP-A-2003-237078 discloses an inkjet head having a large number of pressure chambers arrayed in a matrix. FIG. 11A is a schematic view of nozzle arrays when the inkjet head disclosed in JP-A-2003-237078 is used as a line head. In the inkjet head shown in FIG. 11A, sixteen nozzles are present in each belt-like region R delimited by a large number of straight lines extending in a paper conveyance (sub-scanning) direction. As for the sixteen nozzles 108, the coordinate in a head longitudinal (main scanning) direction and the coordinate in the paper conveyance (sub-scanning) direction differ from one nozzle to another. When the sixteen nozzles 108 are projected from the sub-scanning direction onto a virtual straight line extending in the main scanning direction, sixteen projective dots are obtained. The sixteen projective dots are separated at equally spaced intervals corresponding to a printing resolution. Assume that the sixteen nozzles 108 are numbered (1)-(16) in order from the nozzle whose corresponding projective dot is leftmost. Then, the sixteen nozzles 108(1), (9), (5), (13), (2), (10), (6), (14), (3), (11), (7), (15), (4), (12), (8) and (16) are arranged in that order from below. When each belt-like region R is divided equally into four small regions r1, r2, r3 and r4 by straight lines extending in the sub-scanning direction, four nozzles 108 are arranged on a straight line in each small region. Each belt-like region R includes one and the same array pattern of sixteen nozzles 108.

When ink is ejected at short ejection intervals sequentially from each nozzle 108 in such an inkjet head, a large number of straight lines extending in the sub-straight line can be printed so as to be separated at equally spaced intervals equal to the intervals of the aforementioned projective dots as shown in FIG. 11B. Because of the narrow intervals between adjacent ones of the straight lines, the range where the large number of straight lines are printed is observed actually as if it were a filled region.

SUMMARY OF THE INVENTION

In the inkjet head disclosed in JP-A-2003-237078, the distance between a nozzle 108(1) belonging to one belt-like region R and a nozzle 108(16) belonging to another belt-like region R on the left side of the one belt-like region R is very long in the sub-scanning direction as shown in FIG. 11A. Consider that a large number of straight lines are printed as shown in FIG. 11B. When the attachment angle of the ink-jet head is slightly tilted, the interval between the straight line formed by ink ejected from the nozzle 108(1) and the straight line formed by ink ejected from the nozzle 108(16) with respect to the main scanning direction becomes longer than any other interval between adjacent straight lines as shown in FIG. 1C. As a result, periodic bandings 101 appear in a print so as to give observers a feeling of wrongness.

To prevent bandings from occurring, the inkjet head has to be attached to a printer body with very high accuracy. However, the attachment of the inkjet head with high accuracy results in complication of its manufacturing process and increase of its cost.

It is therefore an object of the present invention to provide an inkjet head, which can obtain a preferable printing result without demanding high accuracy in attachment of the inkjet head.

An inkjet head according to one embodiment of the invention includes a plurality of nozzles that eject ink. The nozzles are arranged so that (a) the nozzles are arranged in a first direction on an ink ejection surface to form a plurality of rows parallel to one another; and (b) when the nozzles are projected from a second direction, which is parallel to the ink ejection surface and perpendicular to the first direction, onto a virtual straight line extending in the first direction, projective dots of the nozzles are arranged at equally spaced intervals on the virtual straight line. Each of adjacent projective dot pairs includes two projective dots adjacent to each other. A most-distant adjacent projective dot pair represents an adjacent projective dot pair having a longest distance between two rows, which two nozzles corresponding to two projective dots thereof belong to, among the adjacent projective dot pairs. A spatial frequency, which is determined based on an appearance interval of the most-distant adjacent projective dot pair in the first direction, is lower than a spatial frequency corresponding to a peak value of a visual transfer function.

With this configuration, bandings corresponding to the most-distant adjacent projective dot pairs, which occur due to the inclined attachment angle of the inkjet head, can be made inconspicuous when the inkjet head is used as a line head. Accordingly, a preferable printing result can be obtained without demanding high accuracy in attachment of the ink-jet head.

The visual transfer function (VTF) is a function expressing human sensitivity of visual recognition with respect to a spatial frequency. The visual transfer function is an evaluation criteria of objective print quality with reduced personal dispersion. This evaluation criteria is used for evaluation such that human psychological factors sensuously determining whether the print quality is good or bad is added to quantitative factors of printing in a field of a hard copy using an inkjet system. The visual transfer function is obtained on an experimental basis of sampling a large number of human beings. The visual transfer function draws a curve having a peak value in a specific frequency and having a smaller value as the spatial frequency is farther from the specific frequency. For example, a problem of banding is evaluated using a visual transfer function. On the assumption that N designates a spatial frequency corresponding to a peak value of the visual transfer function, the human sensitivity to banding is the highest when the spatial frequency is N. As the spatial frequency is lower than N or higher than N, the sensitivity to banding is lowered.

According to one embodiment of the invention, a nozzle plate of an inkjet head includes a plurality of nozzles that eject ink. The nozzles are arranged so that (a) the nozzles are arranged in a first direction on an ink ejection surface to form a plurality of rows parallel to one another; and (b) when the nozzles are projected from a second direction, which is parallel to the ink ejection surface and perpendicular to the first direction, onto a virtual straight line extending in the first direction, projective dots of the nozzles are arranged at equally spaced intervals on the virtual straight line. Each of adjacent projective dot pairs includes two projective dots adjacent to each other. A most-distant adjacent projective dot pair represents an adjacent projective dot pair having a longest distance between two rows, which two nozzles corresponding to two projective dots thereof belong to, among the adjacent projective dot pairs. A spatial frequency, which is determined based on an appearance interval of the most-distant adjacent projective dot pair in the first direction, is lower than a spatial frequency corresponding to a peak value of a visual transfer function.

With this configuration, bandings corresponding to the most-distant adjacent projective dot pairs, which occur due to the inclined attachment angle of the inkjet head, can be made inconspicuous when the inkjet head having the nozzle plate set forth above is used as a line head. Accordingly, a preferable printing result can be obtained without demanding high accuracy in attachment of the inkjet head.

DETAILED DESCRIPTION OF THE PREFERRED EMBODIMENTS

Preferred embodiments of the invention will be described below with reference to the drawings.

First Embodiment

<Overall Structure of Head>

Figure 1:
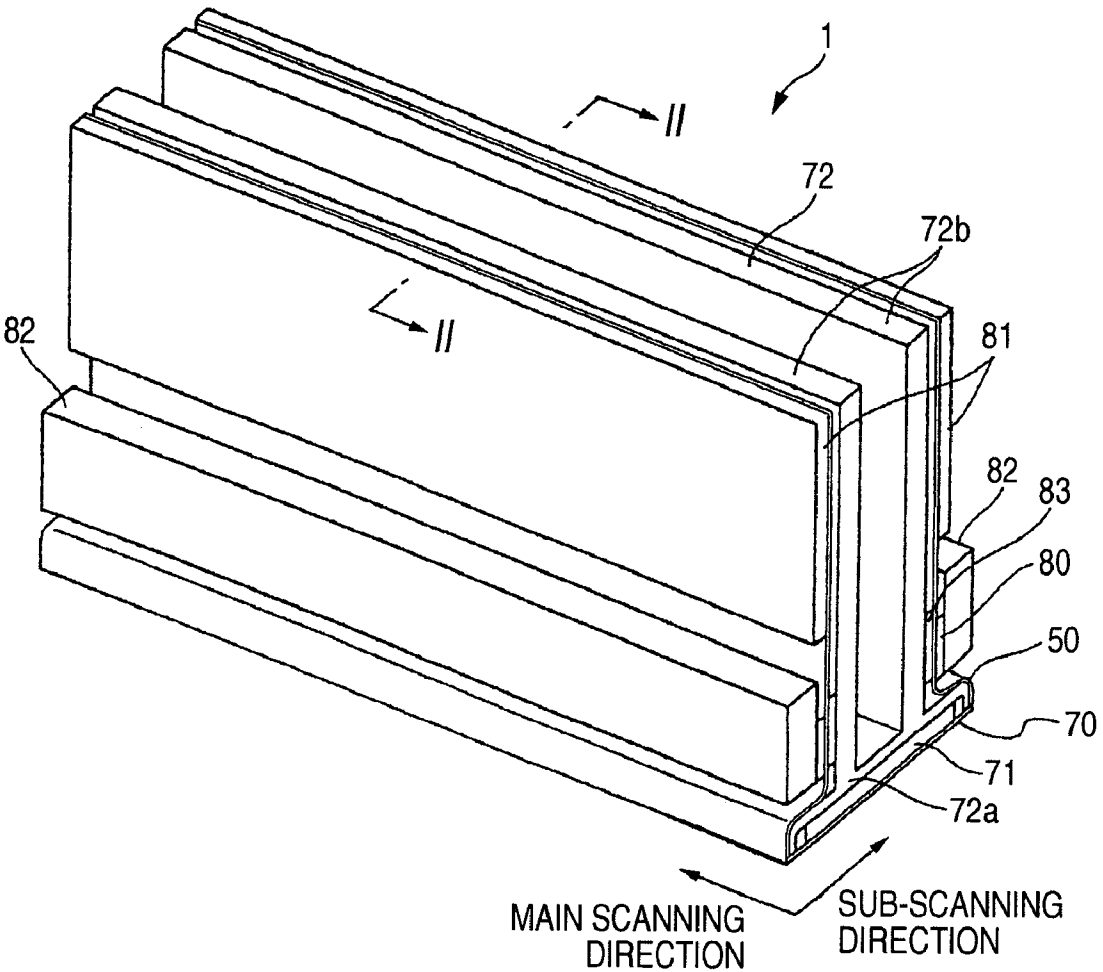
FIG. 1 is an outside perspective view of an inkjet head according to a first embodiment of the invention.
Figure 2:
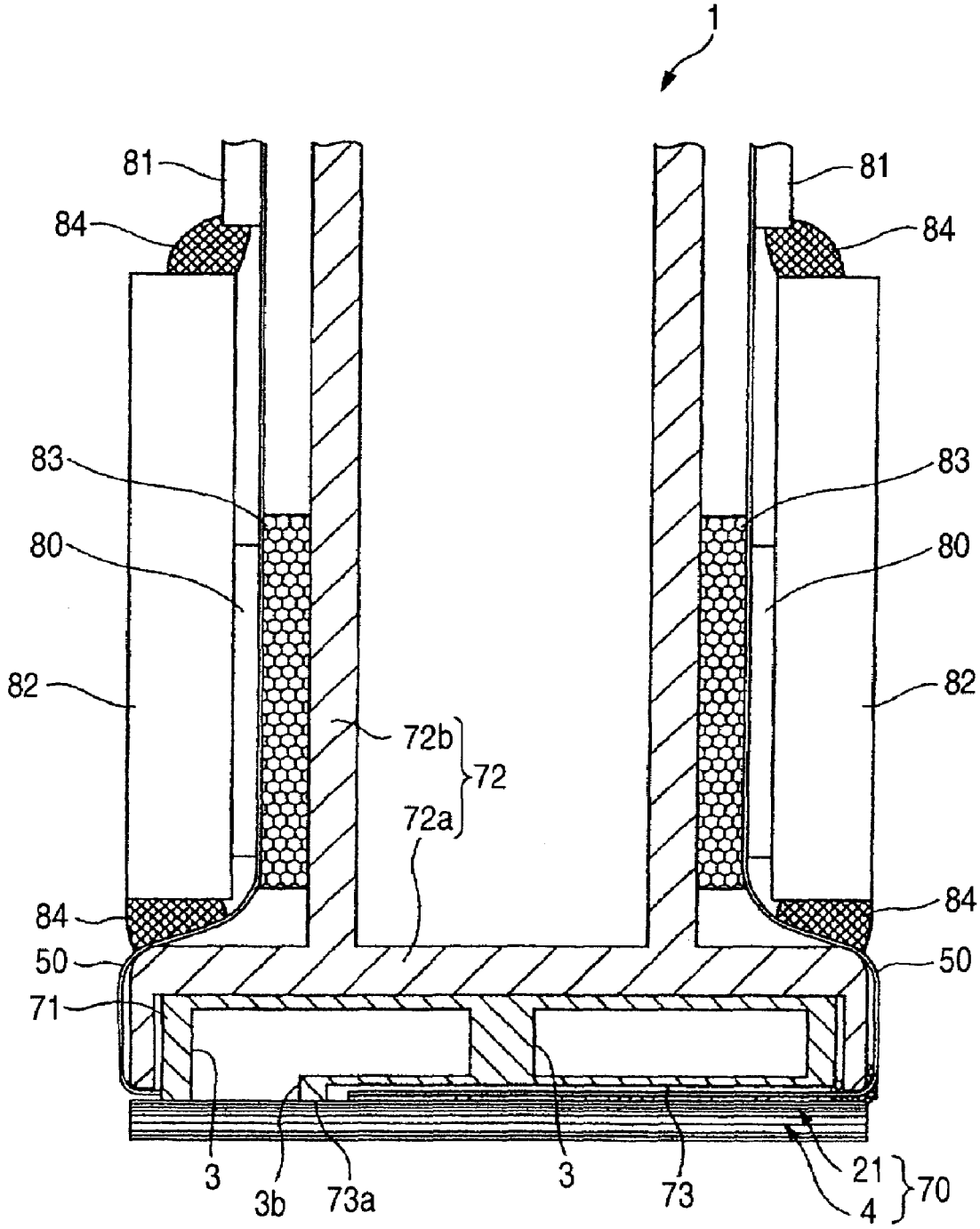
FIG. 2 is a sectional view of the inkjet head shown in FIG. 1.

Description will be made about an inkjet head according to a first embodiment of the invention. FIG. 1 is a perspective view of an inkjet head 1 according to this embodiment. FIG. 2 is a sectional view taken on line II-II in FIG. 1. The ink-jet head 1 has a head body 70 for ejecting ink onto paper, and a base block 71 disposed above the head body 70. The head body 70 has a rectangular planar shape extending in a main scanning direction. The base block 71 is a reservoir unit in which two ink reservoirs 3 are formed. The ink reservoirs 3 serve as ink flow paths from which ink is supplied to the head body 70.

The head body 70 includes a flow path unit 4 in which ink flow paths are formed, and a plurality of actuator units 21 bonded to the upper surface of the flow path unit 4 by an epoxy-based thermosetting bonding agent. The flow path unit 4 and the actuator units 21 have a configuration in which a plurality of thin sheets are laminated and bonded to one another. In addition, a flexible printed circuit (FPC) 50 serving as a feeder member is bonded to the upper surface of each actuator unit 21 by solder, and led to left or right.

Figure 3:
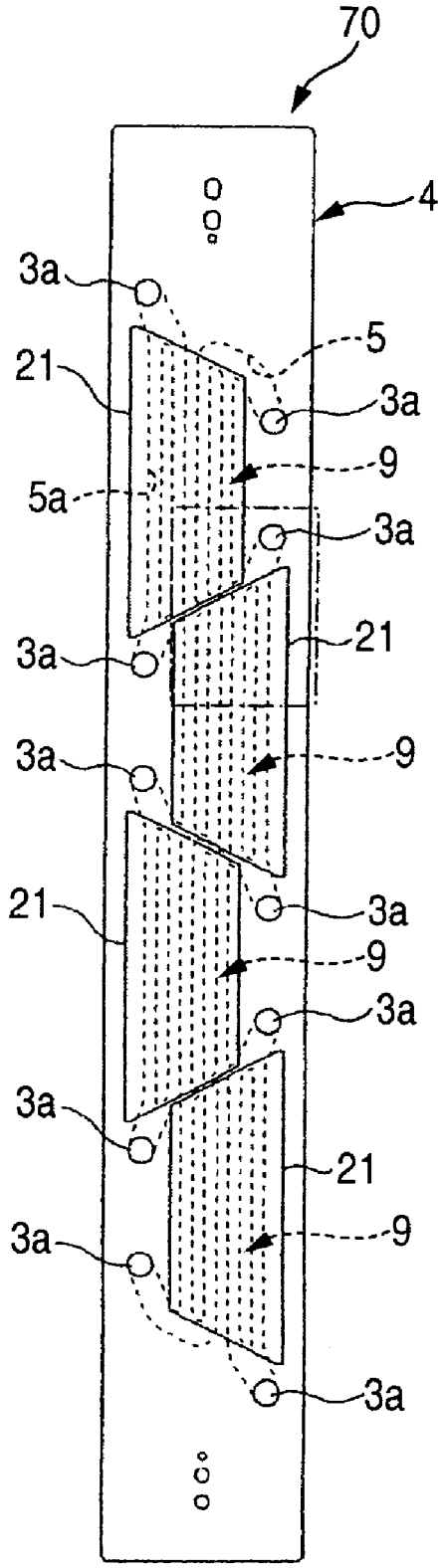
FIG. 3 is a plan view of a head body included in the ink-jet head shown in FIG. 1.

FIG. 3 is a plan view of the head body 70. As shown in FIG. 3, the flow path unit 4 has a rectangular planar shape extending in one direction (main scanning direction). In FIG. 3, a manifold flow path 5 provided in the flow path unit 4 and serving as a common ink chamber is depicted by the broken line. Ink is supplied from the ink reservoirs 3 of the base block 71 to the manifold flow path 5 through a plurality of openings 3*a*. The manifold flow path 5 branches into a plurality of sub-manifold flow paths 5*a* extending in parallel to the longitudinal direction of the flow path unit 4.

Four actuator units 21 each having a trapezoidal planar shape are bonded to the upper surface of the flow path unit 4. The actuator units 21 are arrayed zigzag in two lines so as to avoid the openings 3*a*. Each actuator unit 21 is disposed so that its parallel opposite sides (upper and lower sides) extend in the longitudinal direction of the flow path unit 4. Oblique sides of adjacent ones of the actuator units 21 overlap each other partially in the width direction of the flow path unit 4.

The lower surface of the flow path unit 4 opposite to the bonded region of each actuator unit 21 serves as an ink ejection region where a large number of nozzles 8 (see FIG. 6) are arrayed in a matrix. Pressure chamber groups 9 are formed in the surface of the flow path unit 4 opposite to the actuator units 21. Each pressure chamber group 9 has rhomboid pressure chambers 10 (see FIG. 6) arrayed in a matrix. In other words, each actuator unit 21 has dimensions ranging over a large number of pressure chambers 10.

Returning to FIG. 2, the base block 71 is made of a metal material such as stainless steel. Each ink reservoir 3 in the base block 71 is a substantially rectangular hollow region formed to extend in the longitudinal direction of the base block 71. The ink reservoir 3 communicates with an ink tank (not shown) through an opening (not shown) provided at its one end, so as to be always filled with ink. The ink reservoir 3 is provided with two pairs of openings 3*b* arranged in the extending direction of the ink reservoir 3. The openings 3*b* are disposed zigzag so as to be connected to the openings 3*a* in the regions where the actuator units 21 are not provided.

A lower surface 73 of the base block 71 projects downward near the openings 3*b* in comparison with their circumferences. The base block 71 abuts against the flow path unit 4 only in near-opening portions 73*a* provided near the openings 3*b* in the lower surface 73. Thus, any region of the lower surface 73 of the base block 71 other than the near-opening portions 73*a* is separated from the head body 70, and the actuator units 21 are disposed in these separated regions.

The base block 71 is fixedly bonded into a recess portion formed in the lower surface of a grip 72*a* of a holder 72. The holder 72 includes the grip 72*a* and a pair of flat plate-like protrusions 72*b* extending from the upper surface of the grip 72*a* in a direction perpendicular to the upper surface so as to put a predetermined interval therebetween. Each FPC 50 bonded to the corresponding actuator unit 21 is disposed to follow the surface of the corresponding protrusion 72*b* of the holder 72 through an elastic member 83 of sponge or the like. A driver IC 80 is disposed on the FPC 50 disposed on the surface of the protrusion 72*b* of the holder 72. The FPC 50 is electrically connected to the driver IC 80 and the actuator unit 21 of the head body 70 by soldering so that a driving signal output from the driver IC 80 can be transmitted to the actuator unit 21.

A substantially rectangular parallelepiped heat sink 82 is disposed in close contact with the outside surface of the driver IC 80 so that heat generated in the driver IC 80 can be dissipated efficiently. A board 81 is disposed above the driver IC 80 and the heat sink 82 and outside the FPC 50. Seal members 84 are put between the upper surface of the heat sink 82 and the board 81 and between the lower surface of the heat sink 82 and the FPC 50 respectively so as to bond them with each other.

Figure 4:
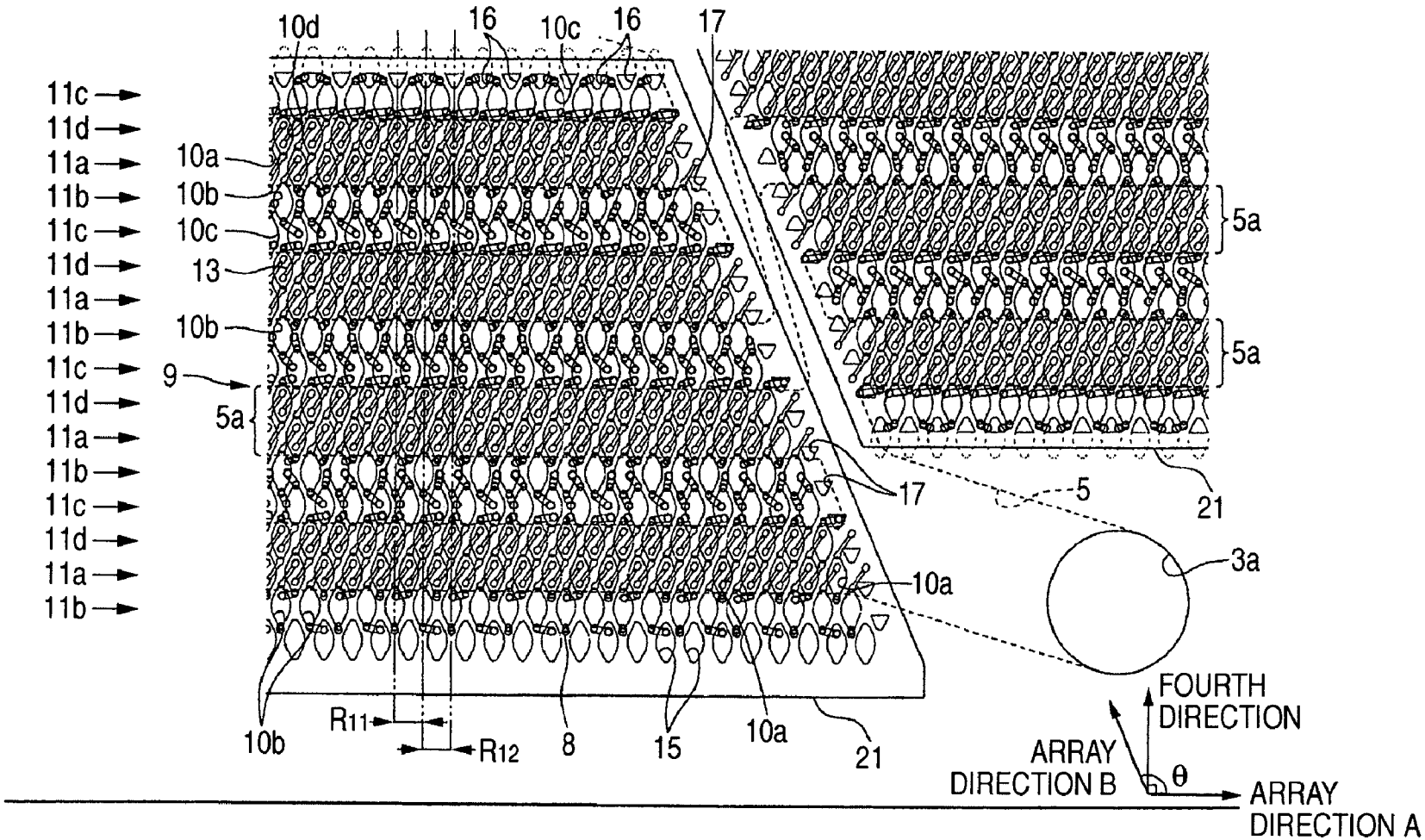
FIG. 4 is an enlarged view of a region surrounded by the one-dot chain line in FIG. 3.
Figure 6:
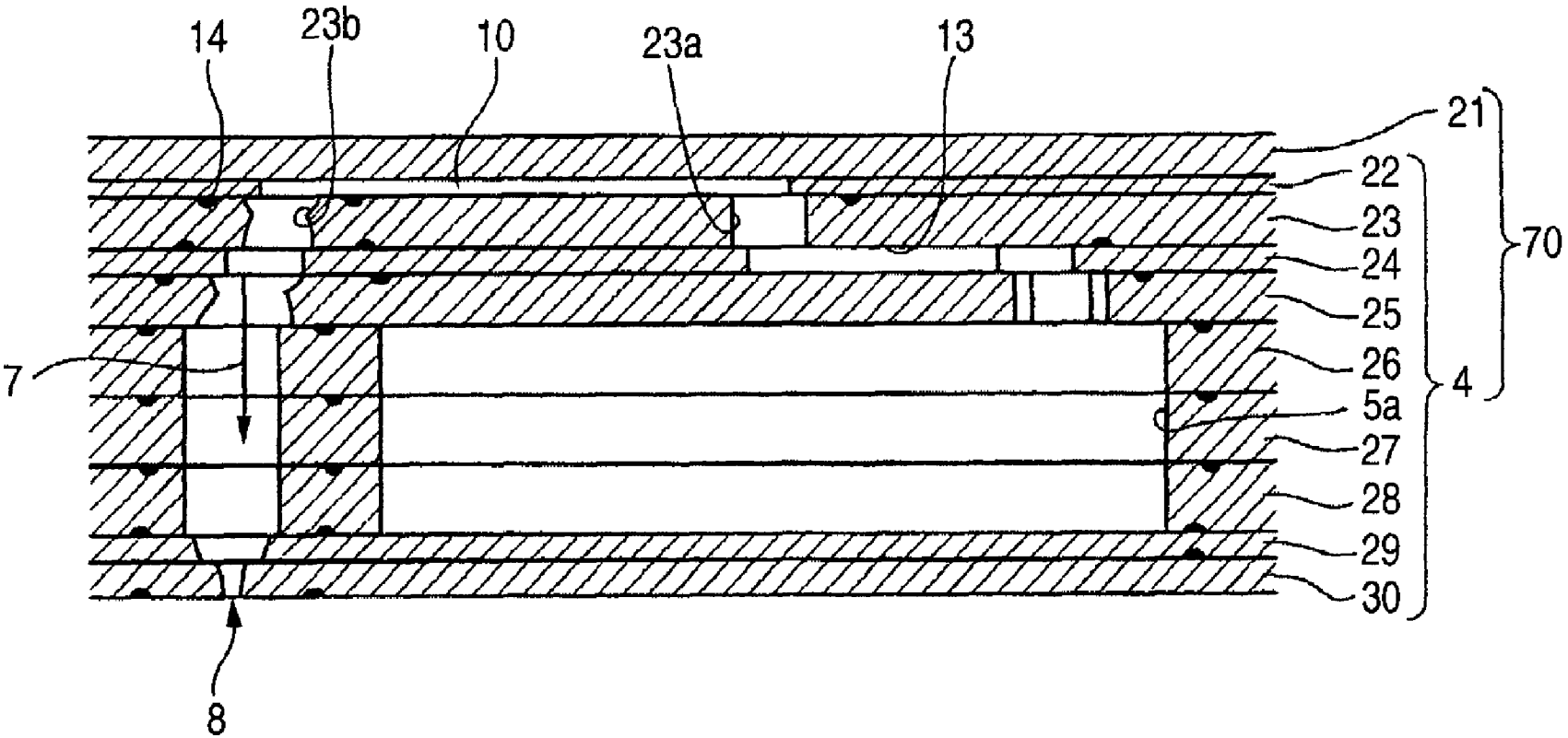
FIG. 6 is a partial sectional view corresponding to a pressure chamber of the head body shown in FIG. 3.

FIG. 4 is an enlarged view of the region surrounded with the one-dot chain line in FIG. 3. As shown in FIG. 4, in the flow path unit 4 opposite to the actuator units 21, eight sub-manifold flow paths 5*a* extend in parallel to the longitudinal direction of the flow path unit 4. A large number of individual ink flow paths are connected to each sub-manifold flow path 5*a* so as to extend from the outlet thereof to the corresponding nozzle 8. FIG. 6 is a sectional view showing an individual ink flow path. As is understood from FIG. 6, each nozzle 8 communicates with the corresponding sub-manifold 5*a* through a pressure chamber 10 (here "pressure chamber 10" designates a representative of the pressure chambers 10*a*, 10*b*, 10*c* and 10*d* depicted in FIG. 4) and an aperture, that is, diaphragm 13. In such a manner, in the head body 70, an individual ink flow path 7 is formed for each pressure chamber 10 so as to extend from the outlet of the sub-manifold 5*a* to the nozzle 8 through the aperture 13 and the pressure chamber 10.

<Head Sectional Structure>

As is understood from FIG. 6, the head body 70 has a laminated structure in which a total of 10 sheet materials of actuator unit 21*s*, a cavity plate 22, a base plate 23, an aperture plate 24, a supply plate 25, manifold plates 26, 27 and 28, a cover plate 29 and a nozzle plate 30 are laminated. Of those sheet materials, the nine plates excluding the plate of the actuator units 21 constitute the flow path unit 4.

In each actuator unit 21, four piezoelectric sheets 41-44 (see FIG. 8) are laminated, and electrodes are disposed, as will be described in detail later. Of the piezoelectric sheets 41-44, only the uppermost layer is set as a layer (hereinafter referred to as "layer having an active portion") having a portion serving as an active portion when an electric field is applied thereto. The other three layers are set as inactive layers having no active portion. The cavity plate 22 is a metal plate in which a large number of rhomboid holes for forming spaces of the pressure chambers 10 are provided within the range where the actuator unit 21 is pasted. The base plate 23 is a metal plate in which communication holes 23*a* and 23*b* are provided for each pressure chamber 10 of the cavity plate 22 so that the communication hole 23*a* makes communication between the pressure chamber 10 and the aperture 13 while the communication hole 23*b* makes communication between the pressure chamber 10 and the nozzle 8.

The aperture plate 24 is a metal plate in which for each pressure chamber 10 of the cavity plate 22 a communication hole between the pressure chamber 10 and the corresponding nozzle 8 is provided in addition to a hole which will serve as the aperture 13. The supply plate 25 is a metal plate in which for each pressure chamber 10 of the cavity plate 22 a communication hole between the aperture 13 and the sub-manifold flow path 5*a* and a communication hole between the pressure chamber 10 and the corresponding nozzle 8 are provided. Each of the manifold plates 26, 27 and 28 is a metal plate in which for each pressure chamber 10 of the cavity plate 22 a communication hole between the pressure chamber 10 and the corresponding nozzle 8 is provided in addition to a corresponding sub-manifold flow path 5*a*. The cover plate 29 is a metal plate in which for each pressure chamber 10 of the cavity plate 22 a communication hole between the pressure chamber 10 and the corresponding nozzle 8 is provided. The nozzle plate 30 is a metal plate in which a nozzle 8 is provided for each pressure chamber 10 of the cavity plate 22.

The ten sheets 21 to 30 are aligned and laminated to one another so that individual ink flow paths 7 are formed as shown in FIG. 6. Each individual ink flow path 7 first leaves upward from the sub-manifold flow path 5*a* and extends horizontally in the aperture 13. Then the individual ink flow path 7 goes upward again and extends horizontally in the pressure chamber 10 again. After that, the individual ink flow path 7 turns obliquely downward so as to leave the aperture 13 for a while, and then turns vertically downward so as to approach the nozzle 8.

As is apparent from FIG. 6, the pressure chambers 10 and the apertures 13 are provided on different levels in the laminated direction of the respective plates. Consequently, in the flow path unit 4 opposite to the actuator units 21, as shown in FIG. 4, an aperture 13 communicating with one pressure chamber 10 can be disposed in a position where it overlaps another pressure chamber 10 adjacent to the one pressure chamber 10 in plan view. As a result, the pressure chambers 10 are brought into close contact with one another and arrayed with high density. Thus, high-resolution image printing can be attained by the inkjet head 1 occupying a comparatively small area.

Escape grooves 14 for letting a surplus bonding agent out are provided in the upper and lower surfaces of the base plate 23 and the manifold plate 28, the upper surfaces of the supply plate 25 and the manifold plates 26 and 27 and the lower surface of the cover plate 29 so as to surround the openings formed in the bonded surfaces of the respective plates. The presence of the escape grooves 14 can prevent variation in flow path resistance from being caused by projection of the adhesive agent into each individual ink flow path when the respective plates are bonded to one another.

<Details of Flow Path Unit>

Refer to FIG. 4 again. A pressure chamber group 9 having a large number of pressure chambers 10 is formed within a range where each actuator unit 21 is attached. The pressure chamber group 9 has a trapezoidal shape substantially as large as the range where the actuator unit 21 is attached. Such a pressure chamber group 9 is formed for each actuator unit 21.

As is apparent from FIG. 4, each pressure chamber 10 belonging to the pressure chamber group 9 is configured to communicate with its corresponding nozzle 8 at one end of its long diagonal, and to communicate with the sub-manifold flow path 5*a* through the aperture 13 at the other end of the long diagonal. As will be described later, individual electrodes 35 (see FIGS. 7 and 8) are arrayed in a matrix on the actuator unit 21 so as to be opposed to the pressure chambers 10 respectively. Each individual electrode 35 has a rhomboid shape in plan view and is one size smaller than the pressure chamber 10. Incidentally, in FIG. 4, the nozzles 8, the pressure chambers 10, the apertures 13, etc. which should be depicted by broken lines are depicted by real lines in order to making the drawing understood easily.

The pressure chambers 10 are disposed contiguously in a matrix in two directions, that is, an array direction A (first direction) and an array direction B (second direction). The array direction A is the longitudinal direction of the ink-jet head 1, that is, the direction in which the flow path unit 4 extends. The array direction A is parallel to the short diagonal of each pressure chamber 10. The array direction B is a direction of one oblique side of each pressure chamber 10, which is at an obtuse angle θ with respect to the array direction A. The two acute angle portions of each pressure chamber 10 are located between two adjacent pressure chambers. Incidentally, the array direction A is parallel to the main scanning direction.

The pressure chambers 10 disposed contiguously in a matrix in the two directions, that is, the array direction A and the array direction B, are separated at an equal distance corresponding to 37.5 dpi from each other in the array direction A. In each actuator unit 21, sixteen pressure chambers 10 are arranged in the array direction B.

The large number of pressure chambers 10 disposed in a matrix form a plurality of pressure chamber rows in parallel to the array direction A shown in FIG. 4. The pressure chamber rows are divided into a first pressure chamber row 11*a*, a second pressure chamber row 11*b*, a third pressure chamber row 11*c* and a fourth pressure chamber row 11*d* in accordance with their relative positions to the sub-manifold flow path 5*a* in view from a direction (third direction) perpendicular to a plane of FIG. 4. Four sets of the first to fourth pressure chamber rows 11*a*-11*d* are disposed periodically in order of 11*c*, 11*d*, 11*a*, 11*b*, 11*c*, 11*d*, . . . , 11*b* from the upper side of the actuator unit 21 toward the lower side thereof.

In the pressure chambers 10*a* forming the first pressure chamber row 11*a* and the pressure chambers 10*b* forming the second pressure chamber row 11*b*, the nozzles 8 are unevenly distributed on the lower side of the plane of FIG. 4 with respect to a direction (fourth direction) perpendicular to the array direction A in view from the third direction. The fourth direction is parallel to the sub scanning direction. Specifically, in each pressure chamber 10*a*, the nozzle 8 is substantially opposite to the lower end acute angle portion of the pressure chamber 10*a* in view from the third direction. In each pressure chamber 10*b*, the nozzle 8 is opposite to a longitudinally central portion of a pressure chamber 10*c* adjacent to the right lower of the lower end acute angle portion of the pressure chamber 10*b* in view from the third direction. On the other hand, in the pressure chambers 10*c* forming the third pressure chamber row 11*c* and the pressure chambers 10*d* forming the fourth pressure chamber row 11*d*, the nozzles 8 are unevenly distributed on the upper side of the plane of FIG. 4 with respect to the fourth direction in view form the third direction. Specifically, in each pressure chamber 10*c*, the nozzle 8 is opposite to a position separated slightly on the right upper from the upper end acute angle portion of the pressure chamber 10*c* in view from the third direction. In each pressure chamber 10*d*, the nozzle 8 is opposite to a portion near the longitudinally lower end of a pressure chamber 10*c* adjacent to the right upper of the upper end acute angle portion of the pressure chamber 10*d* in view from the third direction.

In each of the first and fourth pressure chamber rows 11*a* and 11*d*, at least half the region of each pressure chamber 10*a*, 10*d* overlaps the sub-manifold flow path 5*a* in view from the third direction. In each of the second and third pressure chamber rows 11*b* and 11*c*, almost the whole region of each pressure chamber 10*b*, 10*c* does not overlap the sub-manifold flow path 5*a* in view from the third direction. Accordingly, in any pressure chamber 10 belonging to any pressure chamber row, the width of the sub-manifold flow path 5*a* can be expanded as much as possible to supply ink to each pressure chamber 10 smoothly while the nozzle 8 communicating with the pressure chamber 10 is prevented from overlapping the sub-manifold flow path 5*a*.

Figure 5A:
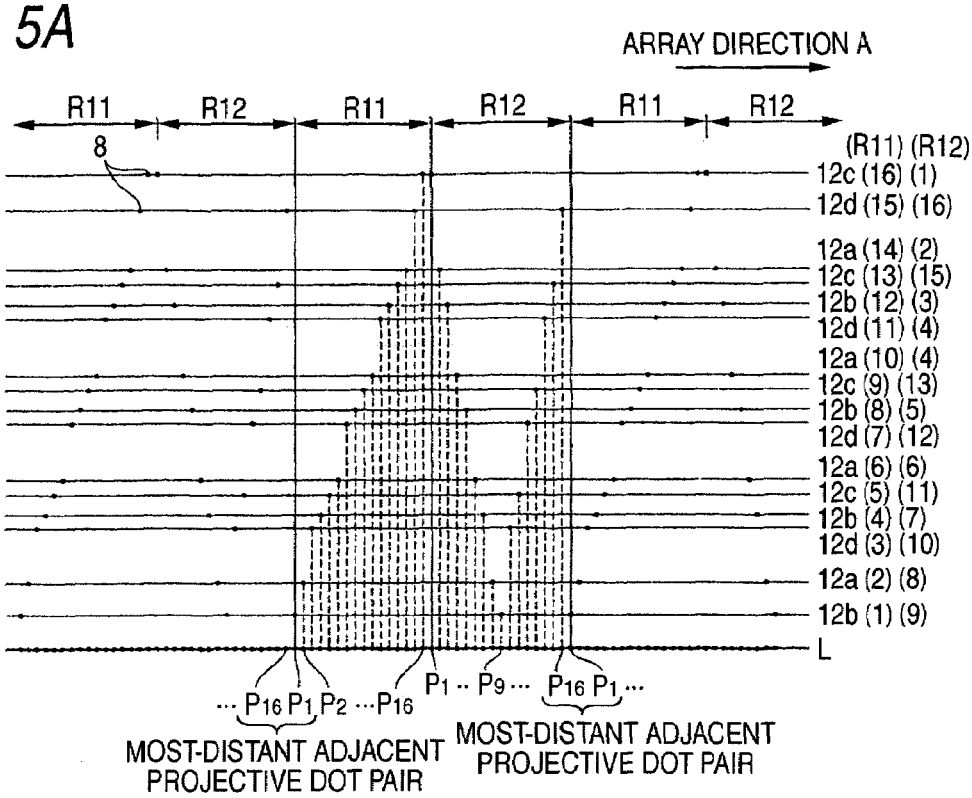
FIGS. 5A-5C are diagrams showing arrays of nozzles shown in FIG. 4, and lines drawn using the nozzles.

FIG. 5A is a schematic diagram showing only the nozzles formed in the nozzle plate 30 depicted in FIG. 4. As shown in FIG. 5A, a plurality of lines parallel to the array direction A are formed by the nozzles 8. Here, a line formed by a plurality of nozzles 8 communicating with the pressure chambers 10*a* will be referred to as a nozzle array row 12*a*, a line formed by a plurality of nozzles 8 communicating with the pressure chambers 10*b* will be referred to as a nozzle array row 12*b*, a line formed by a plurality of nozzles 8 communicating with the pressure chambers 10*c* will be referred to as a nozzle array row 12*c*, and a line formed by a plurality of nozzles 8 communicating with the pressure chambers 10*d* will be referred to as a nozzle array row 12*d*. A total of sixteen lines of the nozzle array rows 12*a*-12*c* are formed. The head row at the top of the plane of FIG. 5A is a nozzle array row 12*c*, which is followed by fourteen rows 12*d*, 12*a*, 12*c*, 12*b*, 12*d*, 12*a*, . . . , 12*a* arranged periodically in that order toward the bottom of the plane. The tail row, that is, the sixteenth row is a nozzle array row 12*b*.

In the inkjet head 1 according to this embodiment, think about two belt-like regions R11 and R12 adjacent to each other, each region R11, R12 having a width (678.0 μm) corresponding to 37.5 dpi in the array direction A and extending in the fourth direction. In each belt-like region R11, R12, only one nozzle 8 is distributed to any row of the sixteen nozzle array rows 12*a*-12*d* shown in FIG. 5A. That is, when such a belt-like region R11, R12 is defined in any position within an ink ejection region corresponding to one actuator unit 21, sixteen nozzles 8 are always distributed in the belt-like region R11, R12. The positions of projective dots P1, P2, . . . , and P16 obtained by projecting the sixteen nozzles 8 from the fourth direction onto a virtual straight line L extending in the array direction A are separated at equally spaced intervals corresponding to 600 dpi, which is a resolution in printing.

Assume that sixteen nozzles 8 belonging to one belt-like region R11 are numbered (1) to (16) respectively in order of increasing distance from the left end of projective dots obtained by projecting the sixteen nozzles 8 onto the virtual straight line L extending in the array direction A. The sixteen nozzles 8(1), (2), (3), (4), . . . , and (16) are arranged in that order from the bottom. That is, as shown in FIG. 5A, the sixteen nozzles 8 are arranged substantially in a straight line from the left bottom to the right top in the belt-like region R11. In the following description, the array pattern of the nozzles 8 within the belt-like region R11 will be referred to as an array pattern AP11. The array pattern AP11 has a feature that the nozzle 8 located in the left end with respect to the array direction A belongs to the tail row, while the nozzle 8 located in the right end belongs to the head row.

Assume that sixteen nozzles 8 belonging to one belt-like region R12 are numbered (1) to (16) respectively in order of increasing distance from the left end of projective dots obtained by projecting the sixteen nozzles 8 onto the virtual straight line L extending in the array direction A. The sixteen nozzles 8(9), (8), (10), (7), (11), (6), (12), (5), (13), (4), (14), (3), (15), (2), (16) and (1) are arranged in that order from the bottom. That is, as shown in FIG. 5A, the sixteen nozzles 8 are arranged substantially in a downward-convex V-shape in the belt-like region R12. In the following description, the array pattern of the nozzles 8 within the belt-like region R12 will be referred to as an array pattern AP12. The array pattern AP12 has a feature that the nozzle 8 located in the left end with respect to the array direction A belongs to the head row, while the nozzle 8 located in the right end belongs to a row other than the tail row. In addition, the nozzle 8 in connection with the ninth projective dot from the left end belongs to the tail row, while the nozzle 8 in connection with the sixteenth projective dot from the left end, that is, the right end projective dot, belongs to the row adjacent to the head row on the tail row side.

The belt-like region R11 and the belt-like region R12 appear alternately. That is, the array pattern AP11 and the array pattern AP 12 appear alternately with respect to the array direction A. Accordingly, in each nozzle array row 12*a*-12*d*, the nozzles 8 having two kinds of predetermined intervals different from each other appear alternately.

As for any pair of projective dots adjacent to each other on the virtual straight line L in connection with nozzles 8 in the belt-like region R11, the nozzles 8 corresponding to the two projective dots belong to rows deviating from each other by only one row. On the other hand, as for any pair of projective dots adjacent to each other on the virtual straight line L in connection with nozzles 8 in the belt-like region R12, the nozzles 8 corresponding to the two projective dots belong to rows deviating from each other by two rows, except that the nozzles 8 corresponding to the projective dots P8 and P9 belong to rows deviating from each other by one row. That is, within the belt-like region R12 having a V-shaped nozzle array, the nozzles 8 in connection with the projective dots on the left side are arranged in the array direction A with being displaced in turn from the left top of the plane (see FIG. 5) toward the right bottom thereof. On the contrary, the nozzles 8 in connection with the projective dots on the right side are arranged in the array direction A with being displaced in turn from the left bottom of the plane toward the right top thereof likewise. The right side and left side center the projective dot P9 corresponding to the nozzle 8 in the tail row. In a direction perpendicular to the array direction A, the nozzle 8 in connection with the projective dot P8 is disposed adjacently to the projective dot P9. Further, in the head row direction, the nozzles 8 in connection with the projective dots on the right side of the projective dot P9 and the nozzles 8 in connection with the projective dots on the left side of the projective dot P9 are disposed alternately and in order of increasing distance from the nozzle 8 corresponding to the projective dot P9. As for all the projective dots on the virtual straight line L, of a plurality of adjacent projective dot pairs each comprised of two projective dots adjacent to each other on the virtual straight line L, an adjacent projective dot pair (most-distant adjacent projective dot pair) comprised of the projective dot P1 corresponding to the left end of the belt-like region R1 and the projective dot P16 corresponding to the right end of the belt-like region R12 are associated with two nozzles 8 belonging to two rows, which are the most distant from each other. The two nozzles 8 corresponding to the most-distant adjacent projective dot pair belong to rows deviating from each other by fourteen rows. The most-distant adjacent projective dot pair appears periodically in the array direction A. The appearance interval of the most-distant adjacent projective dot pair is a distance corresponding to 18.75 dpi (1356 μm), which is half as long as 37.5 dpi. The distance is expressed to be 0.74/mm (=1/1.356 mm) by spatial frequency.

In addition, as shown in FIG. 4, a large number of circumferential spaces 15 each having the same shape and same size as each pressure chamber 10 are arrayed in a straight line all over the long side of the paired parallel sides of the trapezoid of the pressure chamber group 9 in the head body 70. The circumferential spaces 15 are defined by the actuator unit 21 and the base plate 23 closing holes formed in the cavity plate 22 and each having the same shape and the same size as each pressure chamber 10. That is, no ink flow path is connected to any circumferential space 15, and no individual electrode 35 to be opposed is provided in any circumferential space 15. That is, there is no case that any circumferential space 15 is filled with ink.

On the other hand, in the head body 70, a large number of circumferential spaces 16 are arrayed in a straight line all over the short side of the paired parallel sides of the trapezoid of the pressure chamber group 9. Further, in the head body 70, a large number of circumferential spaces 17 are arrayed in a straight line all over each oblique side of the trapezoid of the pressure chamber group 9. Each of the circumferential spaces 16 and 17 penetrates the cavity plate 22 in a region of an equilateral triangle in plan view. No ink flow path is connected to any circumferential space 16, 17, and no individual electrode 35 to be opposed is provided in any circumferential space 16, 17. That is, in the same manner as the circumferential spaces 15, there is no case that any circumferential space 16, 17 is filled with ink.

<Details of Actuator Unit>

Next, description will be made about the configuration of each actuator unit 21. A large number of individual electrodes 35 are disposed in a matrix on the actuator unit 21 so as to have the same pattern as the pressure chambers 10. Each individual electrode 35 is disposed in a position where the individual electrode 35 overlaps the corresponding pressure chamber 10 in plan view.

Figure 7:
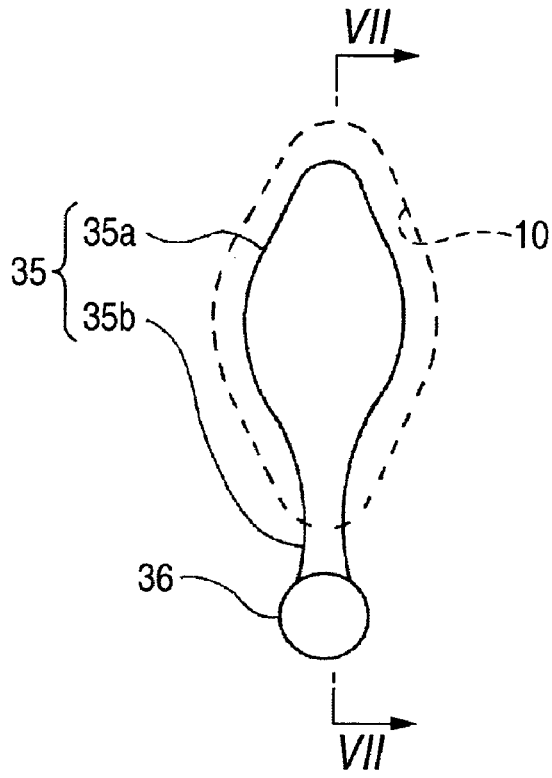
FIG. 7 is a plan view of an individual electrode formed on an actuator unit shown in FIG. 3.

FIG. 7 is a plan view of an individual electrode 35. As shown in FIG. 7, the individual electrode 35 is constituted by a primary electrode region 35*a* and a secondary electrode region 35*b*. The primary electrode region 35*a* is disposed in a position where the primary electrode region 35*a* overlaps the pressure chamber 10, so that the primary electrode region 35*a* is received in the pressure chamber 10 in plan view. The secondary electrode region 35*b* is connected to the primary electrode region 35*a* and disposed out of the pressure chamber 10 in plan view.

Figure 8:
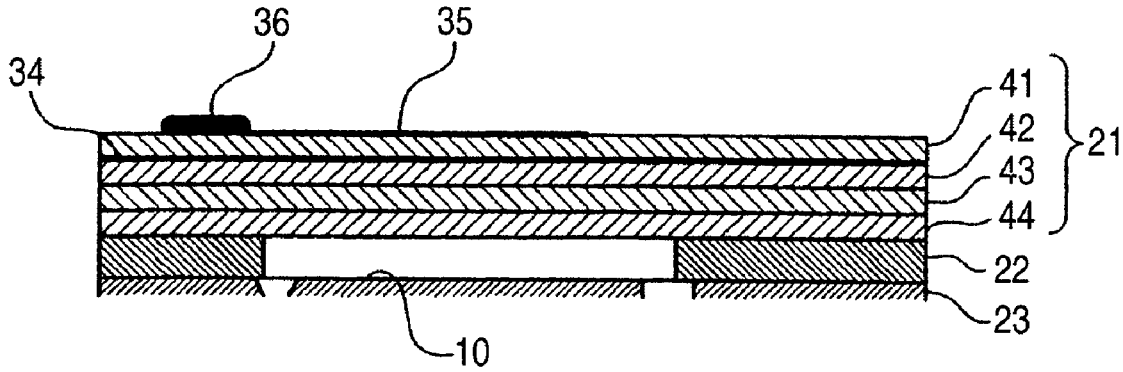
FIG. 8 is a partial sectional view of the actuator unit shown in FIG. 3.

FIG. 8 is a sectional view taken on line VII-VII in FIG. 7. As shown in FIG. 8, the actuator unit 21 includes four piezoelectric sheets 41, 42, 43 and 44 formed to have a thickness of about 15 μm equally. The piezoelectric sheets 41-44 are formed as continuous stratified flat plates (continuous flat plate layers) to be disposed over a large number of pressure chambers 10 formed within one ink ejection region in the head body 70. When the piezoelectric sheets 41-44 are disposed as continuous flat plate layers over a plurality of pressure chambers 10, the individual electrodes 35 can be disposed on the piezoelectric sheet 41 with high density, for example, by use of a screen printing technique. Accordingly, the pressure chambers 10 to be formed in positions corresponding to the individual electrodes 35 can be also disposed with high density. Thus, high-resolution images can be printed. The piezoelectric sheets 41-44 are made of a lead zirconate titanate (PZT) based ceramics material having ferroelectricity.

The primary electrode region 35*a* of each individual electrode 35 formed on the piezoelectric sheet 41 which is the uppermost layer has a rhomboid planar shape which is substantially similar to the pressure chamber 10 as shown in FIG. 7. A lower acute angle portion in the rhomboid primary electrode region 35*a* is extended to be connected to the secondary electrode region 35*b* opposite to the outside of the pressure chamber 10. A circular land portion 36 electrically connected to the individual electrode 35 is provided on the tip of the secondary electrode region 35*b*. As shown in FIG. 8, the land portion 36 is opposed to a region of the cavity plate 22 where no pressure chamber 10 is formed. The land portion 36 is, for example, made of gold containing glass frit. The land portion 36 is bonded onto the surface of an extended portion of the secondary electrode portion 35*b* as shown in FIG. 7. Although the FPC 50 is not shown in FIG. 8, the land portion 36 is electrically connected to a contact point provided in the FPC 50. To establish this connection, it is necessary to press the contact point of the FPC 50 against the land portion 36. Since no pressure chamber 10 is formed in the region of the cavity plate 22 opposed to the land portion 36, the connection can be achieved surely by sufficient pressure.

A common electrode 34 having the same contour as the piezoelectric sheet 41 and having a thickness of about 2 μm is put between the piezoelectric sheet 41 which is the uppermost layer and the piezoelectric sheet 42 which is under the piezoelectric sheet 41. The individual electrodes 35 and the common electrode 34 are made of a metal material such as Ag—Pd based metal material.

The common electrode 34 is grounded in a not-shown region. Consequently, the common electrode 34 is kept in constant potential or the ground potential in this embodiment equally over all the regions corresponding to all the pressure chambers 10. In addition, the individual electrodes 35 are connected to a driver IC 80 through the FPC 50 including a plurality of lead wires which are independent of one another in accordance with the individual electrodes 35. Thus, the potential of each individual electrode 35 can be controlled correspondingly to each pressure chamber 10.

<Method for Driving Actuator Unit>

Next, description will be made about a method for driving each actuator unit 21. The piezoelectric sheet 41 in the actuator unit 21 has a polarizing direction in the thickness direction thereof. That is, the actuator unit 21 has a so-called unimorph type configuration in which one piezoelectric sheet 41 on the upper side (that is, distant from the pressure chambers 10) is set as a layer where an active portion exists, while three piezoelectric sheets 41-43 on the lower side (that is, close to the pressure chambers 10) are set as inactive layers. Accordingly, when the individual electrodes 35 are set at positive or negative predetermined potential, each electric-field-applied portion between electrodes in the piezoelectric sheet 41 will act as an active portion (pressure generating portion) so as to contract in a direction perpendicular to the polarizing direction due to piezoelectric transversal effect, for example, if an electric field is applied in the same direction as the polarization.

In this embodiment, a portion between each primary electrode region 35*a* and the common electrode 34 in the piezoelectric sheet 41 acts as an active portion which will generate a strain due to piezoelectric effect when an electric field is applied thereto. On the other hand, no electric field is applied from the outside to the three piezoelectric sheets 42-44 under the piezoelectric sheet 41. Therefore, the three piezoelectric sheets 42-44 hardly serve as active portions. As a result, mainly the portion between each primary electrode region 35*a* and the common electrode 34 in the piezoelectric sheet 41 contracts in a direction perpendicular to the polarizing direction due to piezoelectric transversal effect.

On the other hand, the piezoelectric sheets 42-44 are not affected by any electric field, they are not displaced voluntarily. Therefore, between the piezoelectric sheet 41 on the upper side and the piezoelectric sheets 42-44 on the lower side, there occurs a difference in strain in a direction perpendicular to the polarizing direction, so that the piezoelectric sheets 41-44 as a whole want to be deformed to be convex on the inactive side (unimorph deformation). In this event, as shown in FIG. 8, the lower surface of the actuator unit 21 constituted by the piezoelectric sheets 41-44 is fixed to the upper surface of the diaphragm (cavity plate) 22 which defines the pressure chambers. Consequently, the piezoelectric sheets 41-44 are deformed to be convex on the pressure chamber side. Accordingly, the volume of each pressure chamber 10 is reduced so that the pressure of ink increases. Thus, the ink is ejected from the corresponding nozzle 8. After that, when the individual electrodes 35 are restored to the same potential as the common electrode 34, the piezoelectric sheets 41-44 are restored to their initial shapes so that the volume of each pressure chamber 10 is restored to its initial volume. Thus, the pressure chamber 10 sucks ink from the sub-manifold flow path 5*a*.

According to another driving method, each individual electrode 35 may be set at potential different from the potential of the common electrode 34 in advance. In this method, the individual electrode 35 is once set at the same potential as the common electrode 34 whenever there is an ejection request. After that, the individual electrode 35 is set at potential different from the potential of the common electrode 34 again at predetermined timing. In this case, the piezoelectric sheets 41-44 are restored to their initial shapes at the same timing when the individual electrode 35 has the same potential as that of the common electrode 34, the volume of the pressure chamber 10 increases in comparison with its initial volume (in the state where the individual electrode 35 and the common electrode 34 are different in potential), so that ink is sucked into the pressure chamber 10 through the sub-manifold flow path 5*a*. After that, the piezoelectric sheets 41-44 are deformed to be convex on the pressure chamber 10 side at the timing when the individual electrode 35 is set at different potential from that of the common electrode 34. Due to reduction in volume of the pressure chamber 10, the pressure on ink increases so that the ink is ejected. In the inkjet head 1 described above, the actuator units 21 are driven suitably in accordance with the conveyance of a printing medium. Thus, characters, graphics, etc. can be drawn with a resolution of 600 dpi.

<Example of Operation in Printing>

As an example of operation in printing, description will be made about a case where a straight line extending in the array direction A is printed with a resolution of 600 dpi. Here, assume that a printing medium is conveyed from the bottom side to the top side in FIG. 5A with respect to the head body 70. In accordance with the conveyance of the printing medium, the sixteen nozzles 8 in the belt-like region R11 are operated as follows. That is, the nozzle 8(1) belonging to the bottom nozzle array row 12*b* in FIG. 5A ejects ink first, and the nozzle 8 belonging to the row just above the bottom nozzle array row 12*b* is next selected to eject ink. In such a manner, the nozzles 8(2), (3) and (4) are selected to eject ink in turn. In this event, the nozzle position is displaced in the array direction A by a fixed distance whenever the selected nozzle array row is moved from the lower side to the upper side by one nozzle array row. Accordingly, within a range corresponding to the belt-like region R11, ink dots are formed adjacently to one another at equally spaced intervals of 600 dpi sequentially toward the right in the array direction A.

On the other hand, the sixteen nozzles 8 in the belt-like region R12 are operated in accordance with the conveyance of the printing medium as follows. That is, the nozzle 8 arrayed in the bottom nozzle array row 12*b* in FIG. 5A ejects ink first, and the nozzle 8 arrayed in the row just above the bottom nozzle array row 12*b* is next selected to eject ink. In such a manner, the nozzles 8 are selected to eject ink in turn. In this event, the displacement of the nozzle position in the array direction A whenever the selected nozzle array row is moved from the lower side to the upper side by one nozzle array row is not fixed. Accordingly, within a range corresponding to the belt-like region R12, the intervals between ink dots formed sequentially in the array direction A in accordance with the conveyance of the printing medium are not fixed to 600 dpi.

That is, as shown in FIG. 5A, in accordance with the conveyance of the printing medium, ink is ejected first from the nozzle 8(9) arrayed in the bottom nozzle array row 12*b* in FIG. 5A, so that a dot array is formed on the printing medium. After that, in accordance with the conveyance of the printing medium, the position where a straight line should be formed reaches the position of the nozzle 8(8) arrayed in the second nozzle array row 12*a* from the bottom, and ink is ejected from the nozzle 8(8). As a result, a second ink dot is formed at a position displaced from the first formed dot position to the left side in the array direction A by an interval corresponding to 600 dpi.

Next, in accordance with the conveyance of the printing medium, the position where a straight line should be formed reaches the position of the nozzle 8(10) arrayed in the third nozzle array row 12*d* from the bottom, and ink is ejected from the nozzle 8(10). As a result, a third ink dot is formed at a position displaced from the first formed dot position to the right side in the array direction A by an interval corresponding to 600 dpi. Further, in accordance with the conveyance of the printing medium, the position where a straight line should be formed reaches the position of the nozzle 8(7) arrayed in the fourth nozzle array row 12*b* from the bottom, and ink is ejected from the nozzle 8(7). As a result, a fourth ink dot is formed at a position displaced from the first formed dot position to the left side in the array direction A by a distance twice as long as an interval corresponding to 600 dpi. Further, in accordance with the conveyance of the printing medium, the position where a straight line should be formed reaches the position of the nozzle 8(11) arrayed in the fifth nozzle array row 12*c* from the bottom, and ink is ejected from the nozzle 8(11). As a result, a fifth ink dot is formed at a position displaced from the first formed dot position to the right side in the array direction A by a distance twice as long as an interval corresponding to 600 dpi.

In such a manner, the nozzles 8 are selected in turn from one located at the bottom in FIG. 5A to one located at the top in FIG. 5A, so that ink dots are formed. In this event, on the assumption that N designates the number suffixed to each nozzle 8 shown in FIG. 5A, the nozzle 8(N) forms an ink dot at a position displaced from the first formed dot position in the array direction A by a distance corresponding to (scale n(=N−9))×(interval corresponding to 600 dpi). A positive sign of the scale n designates displacement to the right side in the array direction A, and a negative sign of the scale n designates displacement to the left side in the array direction A. When the selection of the sixteen nozzles 8 is terminated finally, seven dots are formed on the right side in the array direction A with respect to the ink dot formed by the nozzle 8(9) in the bottom nozzle array row 12*b* in FIG. 5A so as to be separated at intervals corresponding to 600 dpi. On the other hand, eight dots are formed on the left side in the nozzle array row 12*b* likewise. When a nozzle 8 in the belt-like region R11 belongs to the same row as a nozzle 8 in the belt-like region R12, the nozzles 8 eject ink concurrently. As a result, a straight line extending in the array direction A with a resolution of 600 dpi as a whole can be drawn.

Incidentally, each of the neighborhoods of the opposite end portions (oblique sides of the actuator unit 21) in the array direction A of each ink ejection region has a correlation with the neighborhood of an opposed one of the opposite end portions in the array direction A of an ink ejection region corresponding to another actuator unit 21 opposed in the width direction of the head body 70. Thus, printing with a resolution of 600 dpi can be performed continuously in the array direction A using the two actuator units 21.

Figure 5B:
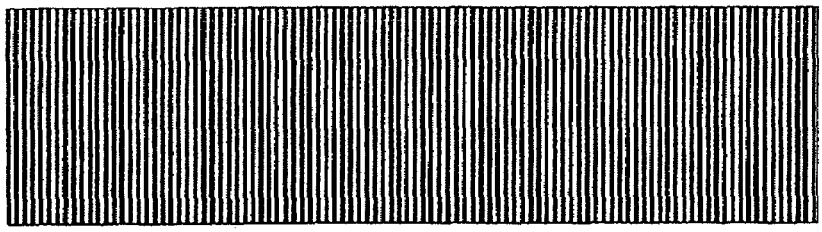

As another example of operation in printing, description will be made about the case where a large number of straight lines extending in the sub-scanning direction (fourth direction) are printed adjacently to one another at equally spaced intervals of 600 dpi. In this case, any nozzle 8 belonging to any belt-like region R11, R12 ejects ink sequentially at short ejection intervals. FIG. 5B shows an example of printing when the inkjet head 1 is attached with high accuracy so that the inkjet head 1 hardly tilts. Such a range where a large number of straight lines have been printed with a resolution of 600 dpi is observed as if it were a filled region. Here, such a range is illustrated as a set of a large number of lines for the sake of explanation. As is also understood from FIG. 5B, no banding appears in the print surface in this case.

Figure 5C:
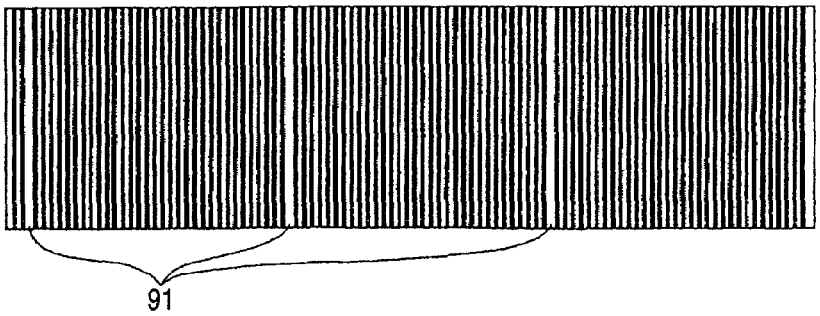

FIG. 5C shows an example of printing when the attachment angle of the inkjet head 1 is slightly inclined so that the sub-scanning direction and the array direction A do not cross at right angles. In this case, as is also understood from FIG. 5C, bandings 91 appear in the print surface. The bandings 91 appear at positions corresponding to the most-distant adjacent projective dot pairs. Accordingly, the appearance interval of the bandings 91 is a distance corresponding to 18.75 dpi, which is equal to the interval of the most distant projective dot pairs in the array direction A. The bandings 91 appear thus the positions corresponding to the most-distant adjacent projective dot pairs for the following reason. When the attachment angle of the inkjet head 1 is inclined, the distance between adjacent two of printed straight lines increases as rows, which two nozzles corresponding to two projective dots adjacent to each other belong to, are more distant from each other.

Figure 9:
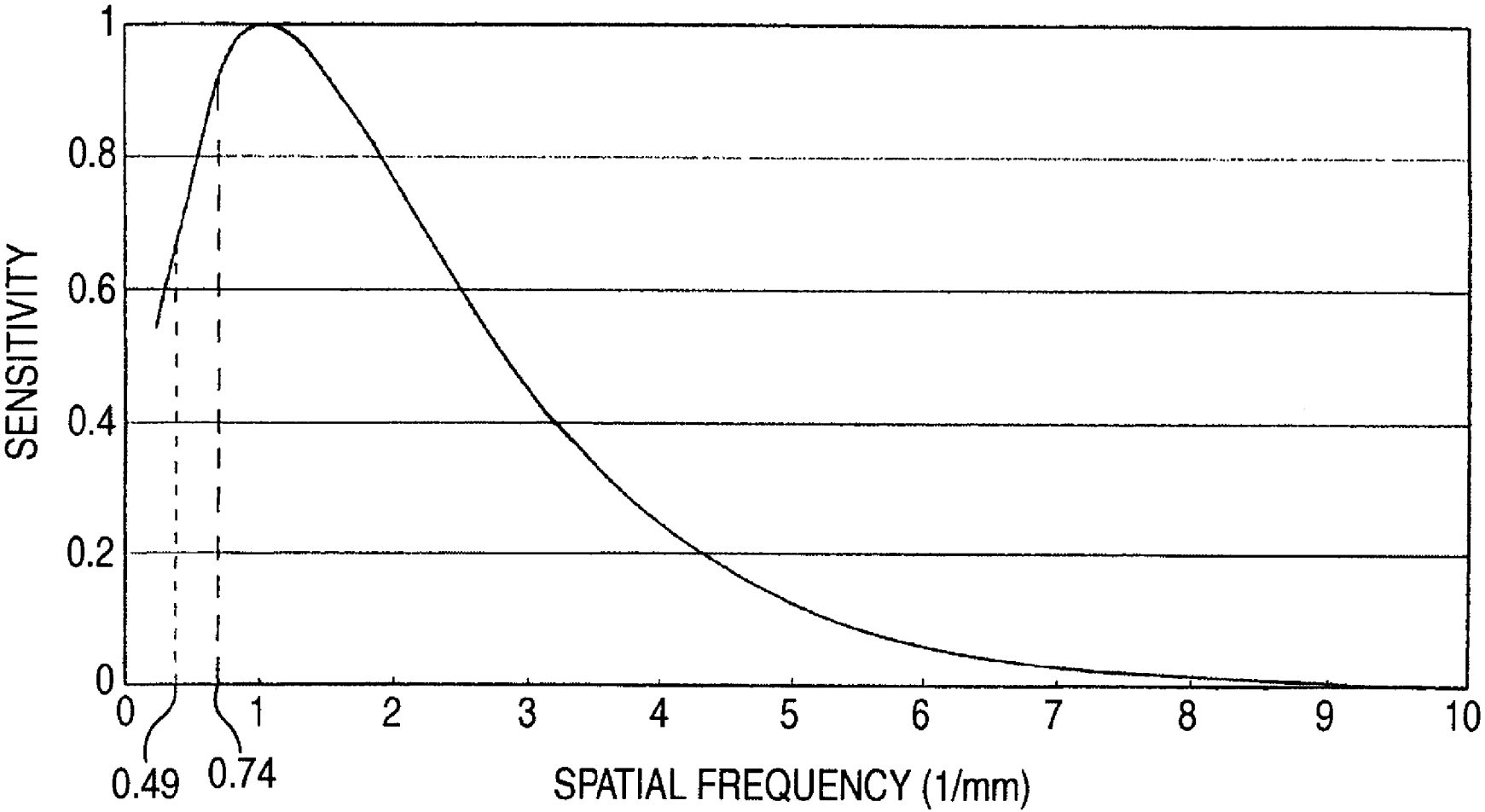
FIG. 9 is a graph showing a visual transfer function.

FIG. 9 shows a graph drawing a visual transfer function which is a function expressing the relationship between a spatial frequency depending on the appearance interval of bandings and the human sensitivity of visual recognition to the spatial frequency. The visual transfer function (VTF) curve depicted in FIG. 9 is obtained from the expression $$VTF = 5.05 \times \exp(-0.138 \times x \times f \times \pi/180) \times \{1 - \exp(-0.1 \times x \times f \times \pi/180)\}$$

where x designates the observation distance and f designates the spatial frequency. In FIG. 9, the visual transfer function is calculated with assuming that x=30 cm.

In the visual transfer function shown in FIG. 9, the sensitivity reaches a peak value when the spatial frequency is about 1/mm. That is, banding is the most conspicuous when the spatial frequency thereof is about 1/mm. As the spatial frequency is lower or higher than 1/mm, the sensitivity of visual recognition becomes lower, and the banding becomes more inconspicuous.

In this embodiment, the spatial frequency of the most-distant adjacent projective dot pairs and the spatial frequency of the bandings 91 corresponding thereto are about 0.74/mm (=1/1.356 mm). At this time, the value of sensitivity of the visual transfer function is about 0.9 on the assumption that the value is 1 when the spatial frequency is 1/mm. Thus, the bandings formed on a printing medium can be made more inconspicuous than those in the spatial frequency 1/mm. As a result, a preferred printing result in which visual deterioration in image quality is suppressed can be obtained without attaching the inkjet head 1 with high accuracy. In addition, the cost required for attaching the inkjet head 1 can be reduced so that a printer can be manufactured at a low cost.

Particularly, in this embodiment, two nozzles 8 corresponding to two projective dots forming each most distant adjacent projective pair belong to two lines which are outermost rows (head row and tail row) of sixteen lines. Therefore, bandings are apt to occur even when the head tilts slightly. It is, however, possible to make the bandings inconspicuous even in such a case.

The appearance interval of the most-distant adjacent projective dot pairs in the array direction A is a distance twice as long as the width (37.5 dpi) of each belt-like region R11, R12. Accordingly, the spatial frequency of the bandings 91 caused by the inclined attachment angle of the inkjet head 1 can be lowered on a large scale. As a result, the bandings can be made more inconspicuous.

Further, a large number of nozzles 8 are arrayed in each nozzle array row 12*a*-12*d* so that two kinds of predetermined intervals different from each other appear alternately. Accordingly, each array of nozzles 8 has regularity so that it becomes easy to manufacture the inkjet head land particularly to manufacture the nozzle plate 30 in which the nozzles 8 are formed.

In view of making the bandings inconspicuous, it is preferable that the spatial frequency of the bandings 91 is made smaller than about 0.74/mm. For example, it is preferable that the spatial frequency is not higher than about 0.65/mm (spatial frequency corresponding to 80% of the sensitivity peak value), and it is more preferable that the spatial frequency is not higher than about 0.5/mm (spatial frequency corresponding to 70% of the sensitivity peak value). To make the spatial frequency of the bandings 91 lower, the appearance interval of the most-distant adjacent projective dot pairs may be increased.

Second Embodiment

Next, description will be made about a second embodiment of the invention. The configuration of an inkjet head according to this embodiment is similar to that in the first embodiment and the same as the configuration shown in FIGS. 1-8, except the arrays of nozzles. The following description will be made focusing on difference between the both, and redundant description will be omitted to the utmost.

Figure 10A:
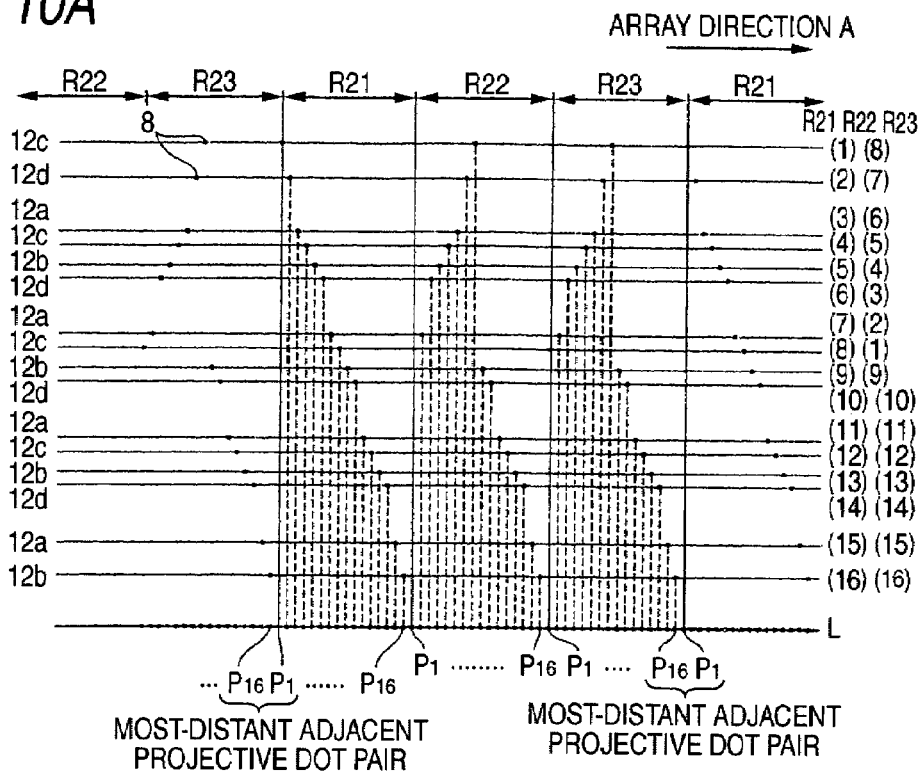
FIGS. 10A-10C are diagrams showing arrays of nozzles of an inkjet head according to a second embodiment of the invention, and lines drawn using the nozzles.

FIG. 10A is a schematic view showing arrays of nozzles 8 formed in a nozzle plate 30, correspondingly to FIG. 5A of the first embodiment. A large number of nozzles 8 are arrayed on sixteen nozzle array rows 12*a*-12*d* parallel to the array direction A in the same manner as in the first embodiment.

Think about three belt-like regions R21, R22 and R23 adjacent to one another, each region R21, R22, R23 having a width (678.0 μm) corresponding to 37.5 dpi in the array direction A and extending in a direction (fourth direction) perpendicular to the array direction A. In each belt-like region R21, R22, R23, only one nozzle is disposed in each of sixteen nozzle array rows 12*a*-12*d* shown in FIG. 10A. That is, when such a belt-like region R21, R22, R23 is delimited in any position within an ink ejection region corresponding to one actuator unit 21, sixteen nozzles 8 are always disposed in each of the belt-like region R21, R22, R23. The positions of projective dots P1, P2, . . . , and P16 obtained by projecting the sixteen nozzles 8 from the fourth direction onto a virtual straight line L extending in the array direction A are separated at equally spaced intervals corresponding to 600 dpi, which is a resolution in printing.

Assume that sixteen nozzles 8 belonging to one belt-like region R21 are numbered (1) to (16) respectively in order of increasing distance from the left end of projective dots obtained by projecting the sixteen nozzles 8 onto the virtual straight line L extending in the array direction A. The sixteen nozzles (16), (15), (14), (13), . . . , and (1) are arranged in that order from the bottom. That is, as shown in FIG. 10A, the nozzles 8 are arranged substantially in a straight line from the left top to the right bottom in the belt-like region R21. In the following description, the array pattern of the nozzles 8 within the belt-like region R21 will be referred to as an array pattern AP21.

Assume that sixteen nozzles 8 belonging to one belt-like region R22 are numbered (1) to (16) respectively in order of increasing distance from the left end of projective dots obtained by projecting the sixteen nozzles 8 onto the virtual straight line L extending in the array direction A. The sixteen nozzles 8(16), (15), (14), (13), (12), (11), (10), (9), (1), (2), (3), (4), (5), (6), (7) and (8) are arranged in that order from the bottom. That is, as shown in FIG. 10A, the eight nozzles 8(1) to (8) in the left upper portion of the belt-like region R22 are arranged substantially in a straight line from the left bottom to the right top, while the eight nozzles 8(9) to (16) in the right lower portion of the belt-like region R22 are arranged substantially in a straight line from the right bottom to the left top. The relative positions of the eight nozzles 8(9) to (16) in the right lower portion of the belt-like region R22 are the same as the relative positions of the eight nozzles 8(9) to (16) in the right lower portion of the belt-like region R21 respectively. On the other hand, the array of sixteen nozzles 8 belonging to one belt-line region R23 is similar to that in the belt-like region R22. In the following description, the array pattern of the thirty-two nozzles 8 distributed in the belt-like regions R22 and R23 will be referred to as an array pattern AP22.

The belt-like regions R21, R22 and R23 are formed repeatedly and regularly in order of R21, R22, R23, R21, R22, R23 . . . That is, the array pattern AP21 and the array pattern AP22 appear alternately in the array direction A. Accordingly, nozzles 8 appear at equally spaced intervals on each of lower eight nozzle array rows of the sixteen nozzle array rows, while nozzles 8 appear at two kinds of predetermined intervals different from each other on each of upper eight nozzle array rows of the sixteen nozzle array rows.

As for any pair of projective dots adjacent to each other on the virtual straight line L in connection with nozzles 8 in the belt-like region R21, the nozzles 8 corresponding to the two projective dots belong to rows deviating from each other by only one row. On the other hand, as for any pair of projective dots adjacent to each other on the virtual straight line L in connection with nozzles 8 in the belt-like region R22 or R23, the nozzles 8 corresponding to the two projective dots belong to rows deviating from each other by one line, except that the nozzles 8 corresponding to the projective dots P8 and P9 belong to rows deviating from each other by eight rows. In addition, as for an adjacent projective dot pair of the projective dot P16 corresponding to the right end of the belt-like region R21 and the projective dot P1 corresponding to the left end of the belt-like region R22 and an adjacent projective dot pair of the projective dot P16 corresponding to the right end of the belt-like region R22 and the projective dot P1 corresponding to the left end of the belt-like region R23, two corresponding nozzles 8 belong to rows deviating from each other by eight rows. As for all the projective dots on the virtual straight line L, of a plurality of adjacent projective dot pairs each comprised of two projective dots adjacent to each other on the virtual straight line L, an adjacent projective dot pair (most-distant adjacent projective dot pair) comprised of the projective dot P1 corresponding to the left end of the belt-like region R21 and the projective dot P16 corresponding to the right end of the belt-like region R23 are associated with two nozzles 8 belonging to two rows, which are the most distant from each other. The two nozzles 8 corresponding to the most-distant adjacent projective dot pair belong to rows deviating from each other by fourteen rows. Such most-distant adjacent projective dot pairs appear periodically in the array direction A. The appearance interval of the most-distant adjacent projective dot pairs is a distance corresponding to 12.5 dpi (=2034 μm), which is one third of 37.5 dpi. This distance is expressed to be 0.49/mm (=1/2.034 mm) by spatial frequency.

As an example of operation in printing, description will be made about a case where a straight line extending in the array direction A is printed with a resolution of 600 dpi. In accordance with the conveyance of the printing medium, the sixteen nozzles 8 in the belt-like region 21 are operated as follows. That is, the nozzle 8(16) belonging to the bottom nozzle array row 12*b* in FIG. 10A ejects ink first, and the nozzle 8 belonging to the row just above the bottom nozzle array row 12*b* is next selected to eject ink. In such a manner, the nozzles 8(15), (14) and (13) are selected to eject ink in turn. In this event, the nozzle position is displaced in the array direction A by a fixed distance whenever the selected nozzle array row is moved from the lower side to the upper side by one nozzle array row. Accordingly, within a range corresponding to the belt-like region R21, ink dots are formed adjacently to one another at equally spaced intervals of 600 dpi sequentially toward the right in the array direction A.

On the other hand, the sixteen nozzles 8 in each belt-like region 22, 23 are operated in accordance with the conveyance of the printing medium as follows. That is, the nozzle 8(16) arrayed in the bottom nozzle array row 12*b* in FIG. 10A ejects ink first, and the nozzle 8 arrayed in the row just above the bottom nozzle array row 12*b* is next selected to eject ink. In such a manner, the nozzles 8 are selected to eject ink in turn. In this event, before reaching the nozzle 8(9), the nozzle position is displaced to the left side in the array direction A by an interval corresponding to 600 dpi whenever the selected nozzle array row is moved from the lower side to the upper side by one nozzle array row. However, in a range from the nozzle 8(9) to the nozzle 8(1), the nozzle position is displaced to the left side in the array direction A by a distance corresponding to 8× (interval corresponding to 600 dpi). After that, the nozzle position is displaced to the right side in the array direction A by an interval corresponding to 600 dpi whenever the selected nozzle array row is moved from the lower side to the upper side by one nozzle array row. When nozzles 8 in the belt-like regions R21, R22 and R23 belong to one and the same row, the nozzles 8 eject ink concurrently. As a result, a straight line extending in the array direction A with a resolution of 600 dpi as a whole can be drawn.

Figure 10B:
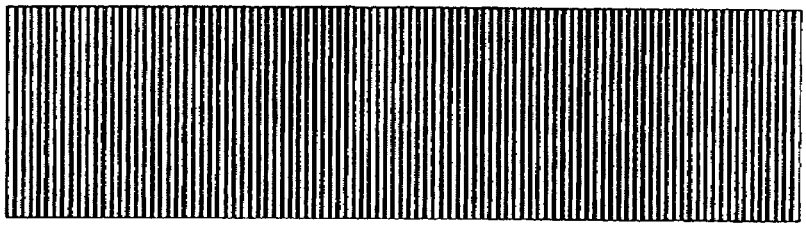

As another example of operation in printing, description will be made about the case where a large number of straight lines extending in the sub-scanning direction (fourth direction) are printed adjacently to each other at equally spaced intervals of 600 dpi. In this case, any nozzle 8 belonging to each belt-like region R21, R22, R23 ejects ink sequentially at short ejection intervals. FIG. 10B shows an example of printing when the inkjet head 1 is attached with high accuracy so that the inkjet head 1 hardly tilts. Such a range where a large number of straight lines have been printed with a resolution of 600 dpi is observed as if it were a filled region. Here, such a range is illustrated as a set of a large number of lines for the sake of explanation. As is also understood from FIG. 10B, no banding appears in the print surface in this case.

Figure 10C:
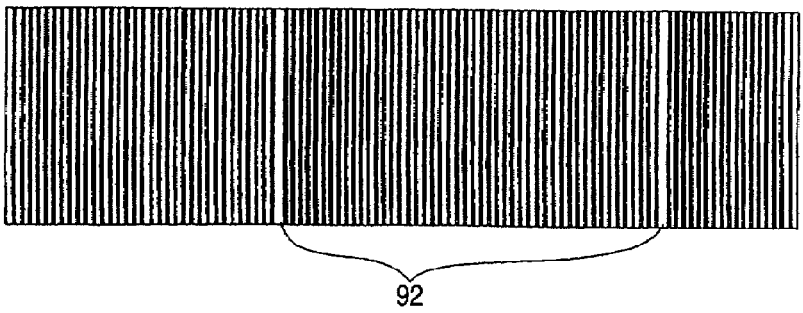
Figure 11A:
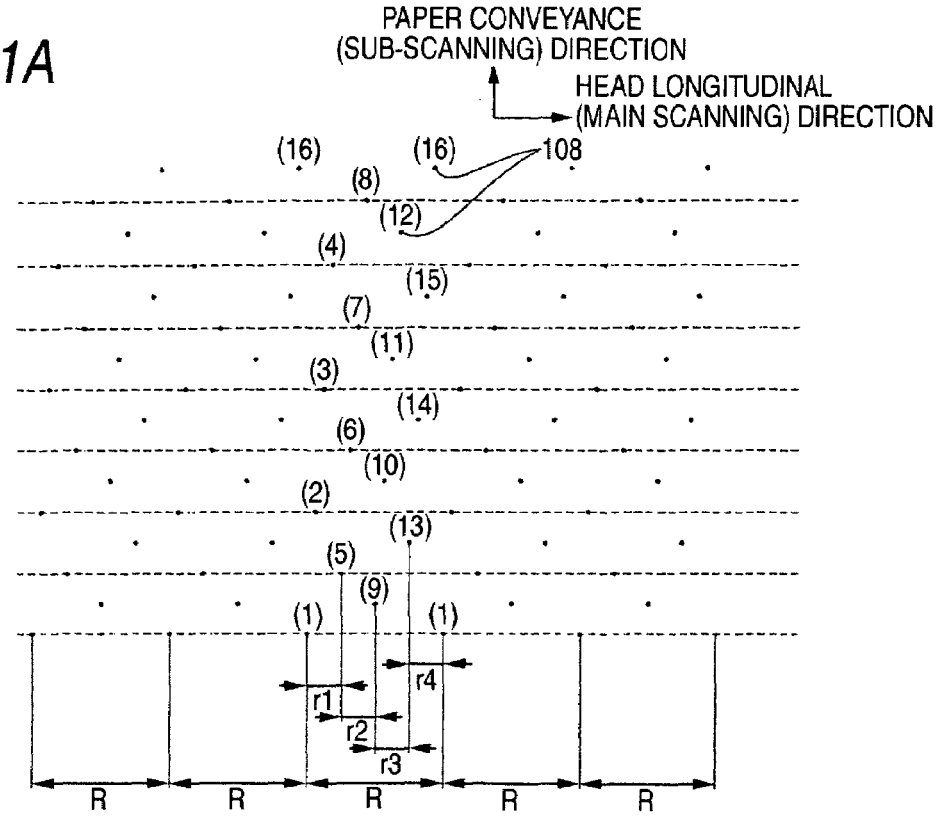
FIGS. 11A-11C are diagrams showing arrays of nozzles of an inkjet head according to the related art, and lines drawn using the nozzles.
Figure 11B:
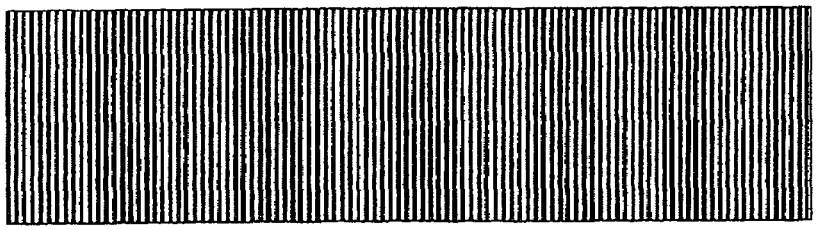
Figure 11C:
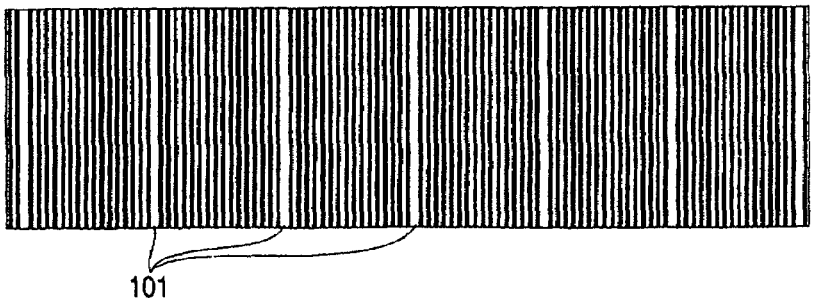

FIG. 1C shows an example of printing when the attachment angle of the inkjet head 1 is slightly inclined so that the sub-scanning direction and the array direction A do not cross at right angles. In this case, as is also understood from FIG. 10C, bandings 92 appear in the print surface. The bandings 92 appear in positions corresponding to the most-distant adjacent projective dot pairs. Accordingly, the appearance interval of the bandings 92 is a distance corresponding to 12.5 dpi, which is equal to the interval of the most distant projective dot pairs. In this embodiment, therefore, the spatial frequency of the most distant adjacent projective dots and the spatial frequency of the bandings 92 corresponding thereto are about 0.49/mm. In this event, with reference to FIG. 9, the value of sensitivity of the visual transfer function is about 0.65 on the assumption that the value is 1 when the spatial frequency is 1/mm. Thus, the bandings formed on a printing medium can be made much more inconspicuous than those in the spatial frequency 1/mm. As a result, a preferable printing result in which visual deterioration in image quality is suppressed can be obtained without attaching the inkjet head 1 with high accuracy.

Particularly, in this embodiment, two nozzles 8 corresponding to two projective dots forming each most distant adjacent projective pair belong to two rows, which are outermost rows (head row and tail row) of sixteen rows. Bandings are apt to occur even when the head tilts slightly. It is, however, possible to make the bandings inconspicuous even in such a case.

The appearance interval of the most-distant adjacent projective dot pairs in the array direction A is a distance three times as long as the width (37.5 dpi) of each belt-like region R21, R22, R23. Accordingly, the spatial frequency of the bandings 92 caused by the inclined attachment angle of the inkjet head 1 can be lowered on a large scale. As a result, the bandings can be made more inconspicuous.

Further, the nozzle array rows 12*a*-12*d* include rows in which a large number of nozzles 8 are arrayed so that two kinds of predetermined intervals different from each other appear alternately, and rows in which a plurality of nozzles 8 are arrayed at equally spaced intervals. Each array of nozzles 8 has regularity thus so that it becomes easy to manufacture the inkjet head 1 and particularly to manufacture the nozzle plate 30 in which the nozzles 8 are formed.

Figure 12:
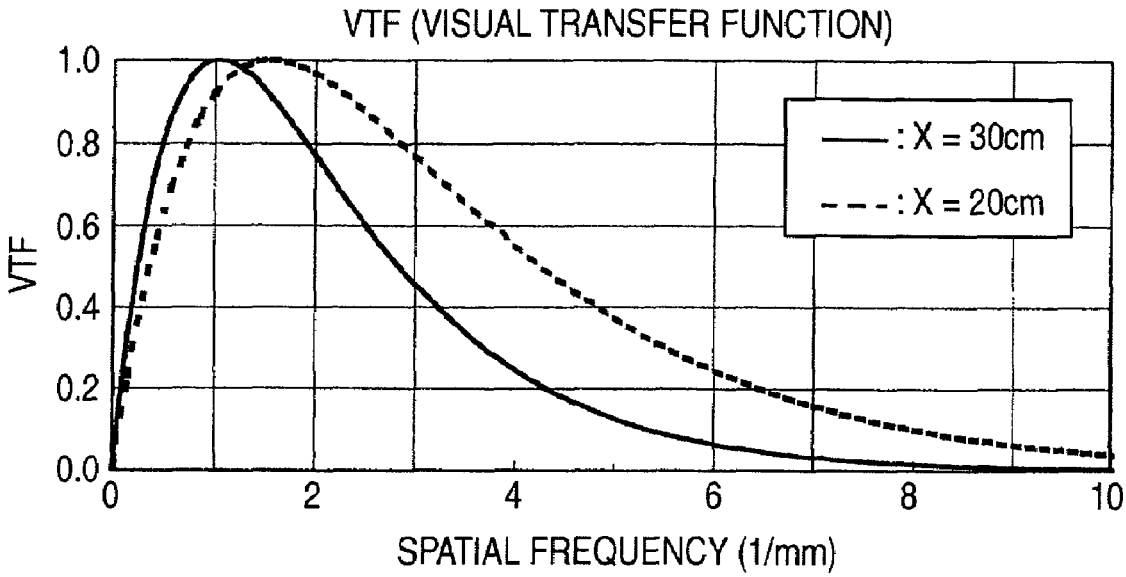
FIG. 12 is graphs showing a visual transfer function with assuming that observation distances are 20 cm and 30 cm.

Description has been made above about the preferred embodiments of the invention. However, the invention is not limited to the aforementioned embodiments. Various changes on design can be made on the invention within the scope stated in claims. For example, the array patterns of nozzles are not limited to those in the aforementioned first and second embodiments. Any change can be made only if the spatial frequency depending on the appearance period of bandings corresponding to the appearance interval of the most-distant adjacent projective dot pairs is lower than a value corresponding to a peak value of the visual transfer function. Also, the visual transfer function may be calculated with assuming that the observation distance x is equal to or less than 30 cm. Dotted lines shown in FIG. 12 shows a visual transfer function with assuming that the observation distance x=20 cm. In this case, the visual transfer function takes a peak value at a spatial frequency about 1.5/mm. On the other hand, the visual transfer function takes about 0.8 at a spatial frequency 0.74/mm (embodiment 1) and about 0.3 at a spatial frequency 0.49/mm (embodiment 2). Thus, when the observation distance x is 20 cm, the embodiments of the invention can also make the bandings formed on a printing medium more inconspicuous than those in the spatial frequency 1.5/mm. _Further, the shapes of flow paths, the shapes of pressure chambers, etc. may be changed suitably.

Also, in the above-described embodiments, a spatial frequency [1/mm] is used as criteria. The spatial frequency can be transformed into a viewing angle ω as follows.

$$f\ [1/\mathrm{mm}] = \frac{1}{\left(2x \times \tan\left(\frac{1}{2\omega'}\right)\right)}\ (\omega'\ [1/\mathrm{rad}]) \Leftrightarrow \omega'\ [1/\mathrm{rad}] = \frac{1}{\left(2 \times \mathrm{atan}\left(\frac{1}{2xf}\right)\right)} \Leftrightarrow \omega\ [1/\mathrm{degree}] = \frac{1}{\left(2 \times \mathrm{atan}\left(\frac{1}{2xf}\right)\right)} \times \frac{\pi}{180}$$

Figure 13:
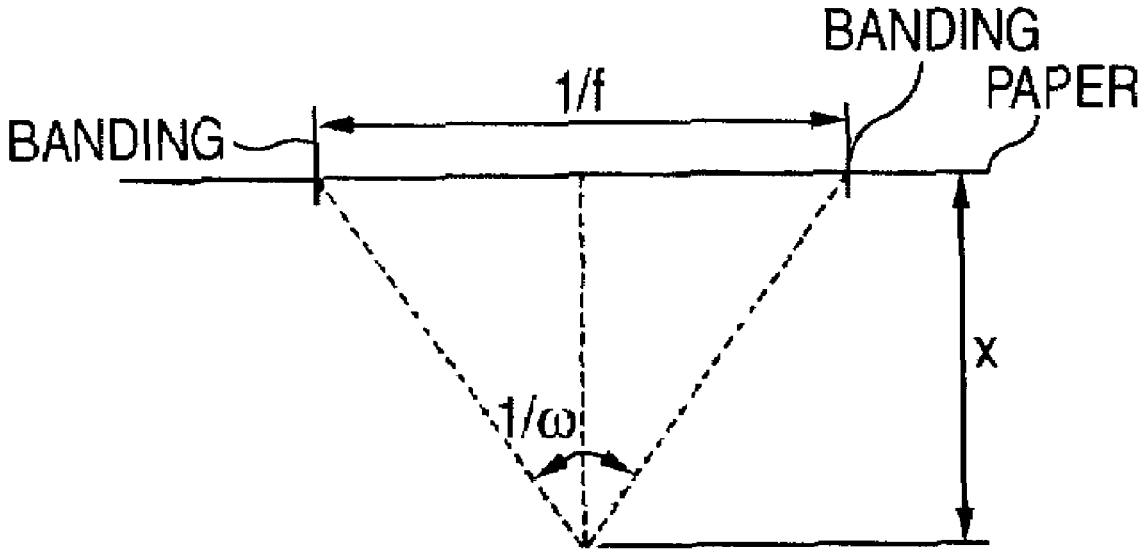
FIG. 13 shows relations among the observation distance x, the spatial frequency f, and the viewing angle ω.

That is, the viewing angle may be used as criteria in place of the spatial frequency. FIG. 13 shows relations among the observation distance x, the spatial frequency f, and the viewing angle ω. According to this transformation formula, the specific values of the spatial frequency are transformed into viewing angles as shown in Table 1.

TABLE 1

| Spatial frequency f [1/mm] | Viewing angle ω [1/degree] |
|---|---|
| 1.00 | 5.236 |
| 0.76 (embodiment 1) | 3.979 |
| 0.49 (embodiment 2) | 2.566 |

(x = 30 cm)

It is apparent from Table 1 that if the viewing angle ω is equal to less than 4.0 (1/degree), the same effect can be achieved as with a case where the spatial frequency is equal to or less than 0.76 (1/mm).

The aforementioned first and second embodiments have been described about the case where the appearance interval of the most-distant adjacent projective dot pairs in the array direction A is an integral multiple of the width in the array direction A of each belt-like region in which one nozzle is disposed in each of sixteen nozzle array rows. The invention is not limited to the case. Accordingly, the appearance interval of the most-distant adjacent projective dot pairs in the array direction A does not have to be an integral multiple of the width of the belt-like region. When the appearance interval is set as an integral multiple, it is not limited to two or three times. It may be set as four or more times.

The aforementioned first and second embodiments have been described about the case where the nozzle array on each nozzle array row has regularity. However, the nozzle array does not have to have regularity. The nozzle array rows may be arrayed at equally spaced intervals.

Also, in the first embodiment, the two belt-like regions R11 and R12, which are different in the array pattern of the nozzles 8, appear alternately. However, from the view point of making the banding occurring at a boundary between different belt-like regions further inconspicuous, a combination (array pattern group) of a single array pattern AP11 and plural array patterns AP12 may be repeated in the array direction A. This modification is similar to the second embodiment in that plural array patterns are repeated. In addition to this similarity, this modification has a feature that the nozzle 8(16) located at one end of the array pattern AP12 in the array direction A and the nozzle 8(1) located at the other end of the array pattern AP12 in the array direction A belong to rows adjacent to each other, respectively. Thus, there is no fear that banding may occur at a boundary between the array patterns AP12 and AP12.

Furthermore, one of the nozzles 8(1), (16) located at both ends of the belt-like region R12 in the array direction A belongs to the head row. Also, the nozzles 8(10), (11), (16) belonging to (2n−1)th rows (n is a natural number) counted from the head row (that is, 2n-th rows counted from the tail row) are arranged on the right side of the nozzle (9) belonging to the tail row. On the other hand, the nozzles 8(1), (2), (8) belonging to 2n-th rows counted from the head row (that is, (2n−1)th rows counted from the tail row) are arranged on the left side of the nozzle 8(9) belonging to the tail row. With this configuration, in a range where the array patterns AP12 are repeated, any of the nozzles 8 corresponding to two projective dots, which are adjacent to each other on the virtual straight line L, belong rows adjacent to each other or rows spaced at a single row therebetween. Accordingly, there is no fear that banding occurs even at a position other than the boundary between the array patterns AP12 and AP12.

Also, since the array pattern group has plural (three or more) array patterns, the banding occurring at a boundary between different array patterns can be made more inconspicuous.

What is claimed is:

1. An inkjet head comprising:

a plurality of nozzles that eject ink, the nozzles arranged so that:

(a) the nozzles are arranged in a first direction on an ink ejection surface to form a plurality of rows parallel to one another; and (b) when the nozzles are projected from a second direction, which is parallel to the ink ejection surface and perpendicular to the first direction, onto a virtual straight line extending in the first direction, projective dots of the nozzles are arranged at equally spaced intervals on the virtual straight line, wherein:

each of adjacent projective dot pairs includes two projective dots adjacent to each other;

a most-distant adjacent projective dot pair represents an adjacent projective dot pair having a longest distance between two rows, which two nozzles corresponding to two projective dots thereof belong to, among the adjacent projective dot pairs; and a spatial frequency, which is determined based on an appearance interval of the most-distant adjacent projective dot pair in the first direction, is lower than a spatial frequency corresponding to a peak value of a visual transfer function.

2. The inkjet head according to claim 1, wherein the visual transfer function is calculated with assuming that an observation distance is equal to or less than 30 cm.

3. The inkjet head according to claim 2, wherein a viewing angle, which is determined based on the appearance interval of the most-distant adjacent projective dot pair in the first direction, is equal to or lower than 4.0 degrees$^{-1}$.

4. The inkjet head according to claim 1, wherein:

the nozzle corresponding to one of the projective dots of the most-distant projective dot pair belongs to a head row, which is located at one end of the rows in the second direction; and the nozzle corresponding to the other of the projective dots of the most-distant projective dot pair belongs to a tail row, which is located at the other end of the rows in the second direction.

5. The inkjet head according to claim 1, wherein:

number of the all rows is expressed as x; and the appearance interval of the most-distant adjacent projective dot pair in the first direction is equal to an integral multiple of a distance between two projective dots on the virtual straight line separated by (x−1) projective dots.

6. The inkjet head according to claim 1, wherein:

number of the all rows is expressed as x; and the appearance interval of the most-distant adjacent projective dot pair in the first direction is equal to a distance, which is twice as long as an interval between two projective dots on the virtual straight line separated by (x−1) projective dots.

7. The inkjet head according to claim 1, wherein in each of the rows, the nozzles are arranged in the first direction so that two kinds of predetermined intervals different from each other appear alternately.

8. The inkjet head according to claim 1, wherein:

the rows include first rows and second rows;

in each of the first rows, the nozzles are arranged at equally spaced intervals; and in each of the second rows, the nozzles are arranged so that two kinds of predetermined intervals different from each other appear alternately.

9. The inkjet head according to claim 1, wherein:

each of first array patterns includes nozzles corresponding projective dots, which are contiguous on the virtual straight line;

each of second array patterns includes other nozzles corresponding projective dots, which are contiguous on the virtual straight line;

number of the nozzles of the first array pattern and number of the nozzles of the second array pattern are equal to predetermined number;

the first array pattern and the second array pattern appear alternately in the first direction;

a head row is located at one end of the rows in the second direction;

a tail row is located at the other end of the rows in the second direction;

in each of the first array patterns, (c) a nozzle located at one end of the first array pattern in the first direction belongs to one of the head row and the tail row;

(d) a nozzle located at the other end of the first array pattern in the first direction belongs to the other of the head row and the tail row; and (e) two nozzles corresponding to two projective dots of each adjacent projective dot pair belong to rows adjacent to each other;

in each of the second array patterns, when one of two nozzles corresponding to two projective dots of an adjacent projective dot pair belongs to the head row or the tail row, the other of the two nozzles belongs to a row other than the head row and the tail row; and the most-distant adjacent projective dot pair includes a projective dot corresponding to the nozzle located at the one end of the first array pattern in the first direction and a projective dot corresponding to a nozzle located at one end of the second array pattern in the first direction.

10. The inkjet head according to claim 9, wherein the nozzle located at the one end of the second array pattern in the first direction belongs to the other of the head row and the tail row.

11. The inkjet head according to claim 9, wherein the nozzle located at the one end of the second array pattern in the first direction belongs to a row adjacent to the other of the head row and the tail row.

12. The inkjet head according to claim 9, wherein:

number of the all rows is expressed as x; and the appearance interval of the most-distant adjacent projective dot pair in the first direction is equal to twice as long as an interval between two projective dots on the virtual straight line separated by (x−1) projective dots.

13. The inkjet head according to claim 1, wherein:

n represents an integer; and in each of the second array patterns, (f) nozzles belonging to 2n-th rows counted from the one of the head row and the tail row are arranged on one side of the nozzle belonging to the one of the head row and the tail row in the first direction; and (g) nozzle belonging to (2n−1)-th rows counted from the one of the head row and the tail row are arranged on the other side of the nozzle belonging to the one of the head row and the tail row in the first direction.

14. The inkjet head according to claim 1, wherein:

each of first array patterns includes nozzles corresponding projective dots, which are contiguous on the virtual straight line;

each of second array patterns includes other nozzles corresponding projective dots, which are contiguous on the virtual straight line;

number of the nozzles of the first array pattern and number of the nozzles of the second array pattern are equal to predetermined number;

an array pattern group including a single first array pattern and a plurality of the second array patterns are arranged periodically in the first direction;

a head row is located at one end of the rows in the second direction;

a tail row is located at the other end of the rows in the second direction;

in each of the first array patterns, (c) a nozzle located at one end of the first array pattern in the first direction belongs to one of the head row and the tail row;

(d) a nozzle located at the other end of the first array pattern in the first direction belongs to the other of the head row and the tail row; and (e) two nozzles of each adjacent projective dot pair belong to rows adjacent to each other;

in each of the second array patterns, when one of two nozzles corresponding to two projective dots of each adjacent projective dot pair belongs to the head row or the tail row, the other of the two nozzles belongs to a row other than the head row and the tail row; and the most-distant adjacent projective dot pair includes a projective dot corresponding to the nozzle located at the one end of the first array pattern in the first direction and a projective dot corresponding to the nozzle located at one end of the second array pattern in the first direction.

15. The inkjet head according to claim 14, wherein the nozzle located at the one end of the second array pattern in the first direction and a nozzle located at the other end of the second array pattern in the first direction belong to rows adjacent to each other, respectively.

16. The inkjet head according to claim 14 wherein the nozzle located at the one end of the second array pattern in the first direction belongs to the other of the head row and the tail row.

17. The inkjet head according to claim 14, wherein the nozzle located at the one end of the second array pattern in the first direction belongs to a row adjacent to the other of the head row and the tail row.

18. The inkjet head according to claim 14, wherein:

n represents an integer; and in each of the second array patterns, (f) nozzles belonging to 2n-th rows counted from the one of the head row and the tail row are arranged on one side in the first direction with respect to the nozzle belonging to the one of the head row and the tail row; and (g) nozzle belonging to (2n−1)-th rows counted from the one of the head row and the tail row are arranged on the other side in the first direction with respect the nozzle belonging to the one of the head row and the tail row.

19. A nozzle plate of an inkjet head comprising:

a plurality of nozzles that eject ink, the nozzles arranged so that:

(a) the nozzles are arranged in a first direction on an ink ejection surface to form a plurality of rows parallel to one another; and (b) when the nozzles are projected from a second direction, which is parallel to the ink ejection surface and perpendicular to the first direction, onto a virtual straight line extending in the first direction, projective dots of the nozzles are arranged at equally spaced intervals on the virtual straight line, wherein:

each of adjacent projective dot pairs includes two projective dots adjacent to each other;

a most-distant adjacent projective dot pair represents an adjacent projective dot pair having a longest distance between two rows, which two nozzles corresponding to two projective dots thereof belong to, among the adjacent projective dot pairs; and a spatial frequency, which is determined based on an appearance interval of the most-distant adjacent projective dot pair in the first direction, is lower than a spatial frequency corresponding to a peak value of a visual transfer function.

* * * * *